US012798834B2

(12) United States Patent
Moore et al.

(10) Patent No.: US 12,798,834 B2
(45) Date of Patent: Nov. 17, 2026

(54) PLASTIC-FREE BOTTLE WITH SILICONE COLLAR

(71) Applicant: PURA STAINLESS LLC, Santa Barbara, CA (US)

(72) Inventors: Jenifer R. Moore, Santa Barbara, CA (US); Roger P. Moore, Santa Barbara, CA (US)

(73) Assignee: PURA STAINLESS LLC, Santa Barbara, CA (US)

( * ) Notice: Subject to any disclaimer, the term of this patent is extended or adjusted under 35 U.S.C. 154(b) by 0 days.

(21) Appl. No.: 19/091,228

(22) Filed: Mar. 26, 2025

(65) Prior Publication Data

US 2025/0333210 A1 Oct. 30, 2025

Related U.S. Application Data

(60) Provisional application No. 63/638,316, filed on Apr. 24, 2024.

(51) Int. Cl.
*B65D 41/04* (2006.01)
*B65D 47/06* (2006.01)

(52) U.S. Cl.
CPC ..... *B65D 41/0492* (2013.01); *B65D 47/06* (2013.01); *B65D 2547/066* (2013.01)

(58) Field of Classification Search
CPC ..... B65D 41/0492; B65D 47/06; B65D 2547/066
USPC ..... 220/713, 319, 320; 215/274
See application file for complete search history.

(56) References Cited

U.S. PATENT DOCUMENTS

| | | | |
|---|---|---|---|
| 1,099,082 | A | 6/1914 | Decker |
| 1,510,363 | A | 9/1924 | Wangen et al. |
| 1,659,784 | A | 2/1928 | Pfister et al. |
| 1,733,184 | A | 10/1929 | William |
| 1,797,433 | A | 3/1931 | McCrea |
| 1,998,646 | A | 4/1935 | Yager et al. |
| 2,008,593 | A | 7/1935 | Pedersen |

(Continued)

FOREIGN PATENT DOCUMENTS

| | | |
|---|---|---|
| AU | 2009200949 | 10/2009 |
| CN | 2813523 | 3/2013 |

(Continued)

OTHER PUBLICATIONS

U.S. Appl. No. 29/640,196 including its prosecution history, the cited references, and the Office Actions therein, Not Yet Published, Jenifer R. Moore.

(Continued)

*Primary Examiner* — Orlando E Aviles
*Assistant Examiner* — Niki M Eloshway
(74) *Attorney, Agent, or Firm* — Knobbe, Martens, Olson & Bear, LLP

(57) ABSTRACT

A bottle includes a container portion, a mouthpiece portion, and an annular portion configured to threadingly engage the container portion to seal the mouthpiece portion to the container portion. The mouthpiece portion can comprise a first silicone material having a first hardness, and the annular portion can comprise a second silicone material having a second hardness that is harder than the first hardness. The bottle can also include an annular support portion coupled to and extending circumferentially around the annular portion.

20 Claims, 19 Drawing Sheets

(56) References Cited

U.S. PATENT DOCUMENTS 2,084,099 A 6/1937 Maccoy
2,157,896 A 5/1939 Held
2,194,004 A 3/1940 Bukolt
2,438,299 A 3/1948 Relis
2,449,014 A 9/1948 Shaffer
D181,337 S 11/1957 Beall, Jr.
2,812,764 A 11/1957 Crisp
2,836,321 A 5/1958 Soltesz et al.
2,844,267 A 7/1958 Petriccione
D188,393 S 7/1960 Fagan
D193,121 S 6/1962 Wickman et al.
3,117,702 A 1/1964 Henchert
3,160,327 A 12/1964 Porcelli
3,168,221 A 2/1965 Parker
3,282,477 A 11/1966 Henchert
3,292,809 A 12/1966 Shomock et al.
3,332,564 A * 7/1967 Meierhoefer ..... A61J 9/08 215/257
3,434,620 A 3/1969 Laurizio
3,445,023 A 5/1969 Giessler et al.
D220,732 S 5/1971 Ritsi
3,788,510 A 1/1974 Collins
3,855,997 A 12/1974 Sauer
4,078,700 A 3/1978 Hidding
4,253,583 A * 3/1981 Lynch ..... F16J 13/065 220/327
4,488,551 A 12/1984 Connelly
D278,414 S 4/1985 Cho
4,613,050 A 9/1986 Atkin et al.
D286,860 S 11/1986 DiFede
D288,241 S 2/1987 Fuller
D306,266 S 2/1990 Hargrove et al.
4,993,568 A 2/1991 Morifuji et al.
D318,427 S 7/1991 Sherburne, Jr.
D319,980 S 9/1991 Garner
D324,824 S 3/1992 Hansen
5,160,058 A 11/1992 Ahn
D336,042 S 6/1993 Bondanza
5,316,160 A 5/1994 Cautereels
D359,234 S 6/1995 Amin
D359,684 S 6/1995 Duggan et al.
5,421,469 A * 6/1995 Lee ..... B65D 55/0872 215/280
D364,810 S 12/1995 Meisner
5,544,766 A 8/1996 Dunn et al.
D374,399 S 10/1996 Neveras et al.
D378,975 S 4/1997 Reid
5,725,121 A 3/1998 Gianpaolo
5,769,277 A 6/1998 Elliott
D404,646 S 1/1999 Black, Sr. et al.
D409,303 S 5/1999 Oepping
5,909,820 A 6/1999 Yeh
5,950,689 A 9/1999 Variet
5,996,859 A 12/1999 Beck
D424,937 S 5/2000 Tucker
D437,782 S 2/2001 Haley et al.
D438,799 S 3/2001 Anderson
6,223,919 B1 5/2001 Kuehn
D448,971 S 10/2001 Hughes
6,357,618 B1 * 3/2002 Kloess ..... B60K 15/03177 220/86.1
6,371,315 B1 4/2002 Chien
D463,567 S 9/2002 Morano
D465,028 S 10/2002 Renz
D466,016 S 11/2002 Serrano et al.
D475,923 S 6/2003 Renz
D479,606 S 9/2003 Randolph
D481,313 S 10/2003 Archer
6,634,417 B1 10/2003 Kolowich
D487,227 S 3/2004 Haley
D504,725 S 5/2005 Randolph et al.
D507,722 S 7/2005 Rockhill
6,948,630 B2 9/2005 Julian et al.
D514,935 S 2/2006 Sturk
6,994,225 B2 2/2006 Hakim
7,070,065 B2 7/2006 Wong
D526,208 S 8/2006 Klein et al.
D531,901 S 11/2006 Rueschhoff et al.
D537,714 S 3/2007 Yerby et al.
D555,795 S 11/2007 Mallet
D567,384 S 4/2008 Sakulsacha et al.
D573,017 S 7/2008 Henderson
D588,616 S 3/2009 Tanaka et al.
D592,505 S 5/2009 Mobley et al.
7,624,868 B2 12/2009 Booker et al.
D617,465 S 6/2010 Hakim
D630,510 S 1/2011 Yacktman
D630,511 S 1/2011 Stull, Sr. et al.
D634,439 S 3/2011 Hakim
7,938,281 B2 5/2011 Horntrich et al.
D639,968 S 6/2011 Pukall et al.
D639,969 S 6/2011 Pukall et al.
D643,722 S 8/2011 Gorskey et al.
D645,339 S 9/2011 Oakes
8,123,086 B2 2/2012 Haley
D666,096 S 8/2012 Cummings et al.
D666,098 S 8/2012 Cummings et al.
D667,558 S 9/2012 Hakim
D671,793 S 12/2012 Hakim
8,322,573 B2 12/2012 Tauber et al.
D676,318 S 2/2013 MacNeill et al.
D678,767 S 3/2013 Haley
D679,589 S 4/2013 Hauth
D681,216 S 4/2013 Smith
D683,189 S 5/2013 Thomas
D693,650 S 11/2013 De Leo
8,573,436 B2 11/2013 Moore et al.
D699,068 S 2/2014 Dunn et al.
8,739,991 B2 6/2014 Moore et al.
D711,230 S 8/2014 den Boer
8,807,386 B2 8/2014 Lam
D713,259 S 9/2014 Naef et al.
D713,724 S 9/2014 Den Boer
8,919,610 B2 12/2014 Haley et al.
D721,976 S 2/2015 Cornelius et al.
D722,173 S 2/2015 Wilson
D722,872 S 2/2015 Bowman et al.
D724,233 S 3/2015 Moore et al.
D728,808 S 5/2015 Sakulsacha
D730,730 S 6/2015 Haley et al.
D731,240 S 6/2015 Bell et al.
RE45,611 E 7/2015 Haley
D734,476 S 7/2015 Chaitanarit
D735,049 S 7/2015 Cornelius et al.
D744,778 S 12/2015 Wahl
D747,200 S 1/2016 Chiorazzi et al.
9,233,052 B2 1/2016 Moore
D749,745 S 2/2016 Prentice
D750,490 S 3/2016 Moore et al.
D752,234 S 3/2016 Moore et al.
D752,434 S 3/2016 Willows
D758,789 S 6/2016 Moore et al.
D767,390 S 9/2016 Miksovsky et al.
D768,490 S 10/2016 Robinson et al.
D769,671 S 10/2016 Bielawski
D769,713 S 10/2016 Moore et al.
D775,525 S 1/2017 Stryker et al.
D776,533 S 1/2017 Kikel
D780,579 S 3/2017 Kim et al.
D781,640 S 3/2017 Roth et al.
D782,245 S 3/2017 Ellsworth et al.
RE46,506 E 8/2017 Haley
D794,811 S 8/2017 Thomas
D795,064 S 8/2017 Moore et al.
D808,802 S 1/2018 Seiders et al.
D815,890 S 4/2018 Boroski
D818,133 S 5/2018 Moore et al.
D820,085 S 6/2018 Moore et al.
D820,996 S 6/2018 Knaus et al.
D821,147 S 6/2018 Chung
D834,414 S 11/2018 Moore et al.
D855,390 S 8/2019 Lullie et al.
D897,206 S 9/2020 Moore et al.
2003/0089676 A1 5/2003 Uehara

(56) References Cited

U.S. PATENT DOCUMENTS

| | | | | |
|---|---|---|---|---|
| 2004/0069786 | A1* | 4/2004 | Monks | B65D 45/32 220/796 |
| 2004/0124168 | A1 | 7/2004 | Silver | |
| 2004/0221385 | A1 | 11/2004 | Su | |
| 2005/0000930 | A1 | 1/2005 | Weissberg | |
| 2005/0006415 | A1 | 1/2005 | Kiehne | |
| 2005/0184026 | A1 | 8/2005 | Haley | |
| 2005/0258201 | A1 | 11/2005 | Willows et al. | |
| 2006/0011571 | A1 | 1/2006 | Silver | |
| 2006/0261064 | A1 | 11/2006 | Holley, Jr. | |
| 2007/0045217 | A1 | 3/2007 | Cho | |
| 2007/0102434 | A1 | 5/2007 | Dunwoody et al. | |
| 2007/0221604 | A1 | 9/2007 | Hakim | |
| 2008/0128418 | A1 | 6/2008 | Ahn | |
| 2008/0282907 | A1 | 11/2008 | Begin et al. | |
| 2009/0261054 | A1 | 10/2009 | Shelby | |
| 2009/0301990 | A1 | 12/2009 | Cresswell et al. | |
| 2010/0181282 | A1 | 7/2010 | Raman | |
| 2010/0264148 | A1* | 10/2010 | MacKay | A47G 19/2272 220/288 |
| 2011/0062105 | A1 | 3/2011 | Itzek | |
| 2012/0074090 | A1 | 3/2012 | Rees | |
| 2012/0305582 | A1 | 12/2012 | Dunn | |
| 2014/0251939 | A1 | 9/2014 | Boonprasop | |
| 2015/0014268 | A1* | 1/2015 | Rhodes | A61J 9/006 215/11.5 |
| 2015/0053637 | A1 | 2/2015 | Archer et al. | |
| 2018/0104155 | A1* | 4/2018 | Reed | A61J 11/045 |
| 2019/0269577 | A1* | 9/2019 | Reed | A61J 11/02 |
| 2021/0009335 | A1* | 1/2021 | Wilshinsky | A47J 31/4407 |

FOREIGN PATENT DOCUMENTS

| | | | | |
|---|---|---|---|---|
| CN | 201320170041.6 | | 12/2013 | |
| CN | 2013305348008 | | 3/2014 | |
| EP | 0151862 | A2 | 8/1985 | |
| EP | 1354579 | A1 | 10/2003 | |
| EP | 002346577-0001 | | 11/2013 | |
| EP | 002346577-0002 | | 11/2013 | |
| GB | 2154451 | A1 | 9/1985 | |
| GB | 2491790 | | 4/2013 | |
| KR | 20-1999-0021881 | | 6/1999 | |
| KR | 10-2000-0022013 | | 4/2000 | |
| KR | 20-2000-0007813 | | 5/2000 | |
| KR | 10-2000-0042244 | | 7/2000 | |
| KR | 20230050141 | A * | 4/2023 | A61J 9/085 |
| WO | WO 0016731 | A1 | 3/2000 | |
| WO | WO 2011/116354 | A2 | 9/2011 | |
| ZA | 2012/07314 | | 11/2012 | |

OTHER PUBLICATIONS

U.S. Appl. No. 29/568,981 including its prosecution history, the cited references, and the Office Actions therein, Not Yet Published, Moore et al.

|Organickidz, About us, www.organickidz.ca/about-us/founder, Pub. Date Unknown.

CamelBak Eddy, .75L BPA-Free Water Bottle for Hydration On the Go. http://shop.camelbak.com/eddy-75l/d/1012_c_755_cl_6192, printed on Mar. 9, 2016.

Tejada, Avoid Bisphenol A when you can, www.azcentral.com/community/chandler/citizen/articles/2009/05/26/20090526fr-askexpert0527.html, May 26, 2009.

My Precious Kid, Baby Bottles—BPA free/stainless steel on sale, http://www.mypreviouskid.com/blog/2009/10/baby-bottles-bpa-freestainless-steel-on-sale/, Oct. 21, 2009.

Mittelstaedt, Bisphenol A poses disease risk for adults, study says, theglobeandmail.com/technology/science/.../article1061117, Sep. 16, 2008.

Mommyauctions, Bottle raid 2007!, Mommyauctions.com/blog/2007/10/01/kitchen-raid-2007-what's-the-scoop-on-all-the-bpa-free-hype, Oct. 21, 2009.

Wellings, Concerns over baby bottles, http://au.news.yahoo.com/today-tonight/latest/article/-/6098435/concerns-over-baby-bottles, Sep. 24, 2009.

Examination Report issued in United Kingdom Patent Application No. GB1218578.1 dated Oct. 31, 2012.

Daley, Harvard study backs bottle concern, says plastic used leaches Bisphenol A, The Boston Globe www.boston.com/lifestyle/green/articles/2009/05/22/harvard study backs bottle concern and: www.organickidz.ca/stainless-steel-bpa/news-articles, May 22, 2009.

International Search Report and Written Opinion for International Application No. PCT/US2011/029098, Notification mailed Nov. 28, 2011.

Consumer Reports, Major baby bottle manufacturers agree to ban BPA, http://news.consumerreports.org/safety/2009/03/baby-bottle-makers-agree-to-ban-bpa.html, Mar. 9, 2009.

Nuby Replacement Spouts, Copyright 2011.

Nuby Clik-it FlexStraw, copyright 2016, https://nuby.com/en/nuby/cups-spouts/10130/.

Cornell University, Plastics—Avoiding BPA, http://envirocancer.cornell.eduenvirocancer.cornell.eduhttp://envirocancer.cornell.edu, Mar. 2009.

Adams, Six baby bottle manufacturers quietly agree to remove BPA from baby bottles, http://www.naturalnews.com/025804_BPA_Baby_Bottles.html, Mar. 9, 2009.

Wiley, Stainless Steel Baby Bottles are the best alternative to plastic, voices.yahoo.com/stainless-steel-baby-bottles-best-alternative-2999481.html?cat=25, Mar. 6, 2009.

Alter, Time to pack in the polycarbonates, http://www.treehugger.com/green-food/time-to-pack-in-the-polycarbonates.html, Aug. 1, 2007.

Thinkbaby, The New Design—Stage B, Cross Cut, No Spill (6 to 12 months)—Two Pack, http://thinkbabybottles.3dcartstores.com/The-New-Design--Stage-B-Cross-Cut-No-Spill-6-to-12-months-Two-Pack-_ p_200.html retrieved May 5, 2015. The publication date of this reference is not readily available. Applicant requests that the Examiner review the reference as prior art. Applicant reserves the right to disqualify the reference as prior art if needed.

Garvey, World's first stainless steel baby bottles—safe, strong and sustainable, www.gizmag.com/worlds-first-stainless-steel-baby-bottles/12910, Sep. 22, 2009.

Manila Mommy, A Review and a Giveaway! Pura Kiki Stainless Steel Bottle, http://manilamommy.com/pura-kiki-review/, Mar. 5, 2012.

Family Education, Pura Stainless Steel Water Bottle Giveaway, http://blogs.familyeducation.com/blogs/lindsay/pura-stainless-steel-water-bottle-giveaway, Sep. 14, 2011.

Stannard, Yale study details how and why of BPA's dangers, www.ehhi.org/plastics/taylor_nhregister_0310.shtml and: www.organickidz.ca/stainless-steel-bpa/news-articles, Mar. 9, 2009.

* cited by examiner

PLASTIC-FREE BOTTLE WITH SILICONE COLLAR

CROSS-REFERENCE TO RELATED APPLICATIONS

This application claims the benefit of U.S. Provisional Patent Application No. 63/638,316, filed Apr. 24, 2024, which is incorporated by reference herein in its entirety.

BACKGROUND

This disclosure generally relates to devices for storage and delivery of fluids and other contents, and more particularly, to plastic free bottles for fluid storage and delivery that utilize a threaded collar.

SUMMARY

Various embodiments of the present disclosure relate to devices for storage and delivery of fluids and other contents for ingestion by humans. For example, various embodiments disclosed herein relate to bottles that include an annular threaded portion, such as a collar, that comprises silicone and/or another material that is generally softer and/or more elastic than typical steels or plastics.

Prior plastic free bottles have utilized, for example, a stainless steel container portion, a silicone nipple or spout, and a stainless steel collar that includes, for example, steel threads that mate with steel threads of the container portion in order to hold the nipple or spout and to seal the nipple or spout to the container portion. Producing both the container portion and the collar from stainless steel, such as from relatively thin sheets of stainless steel that are drawn or otherwise formed into the necessary shapes that include mating threads can be a complicated and costly process, however. For example, it can be difficult to obtain the necessary surface finishes and tolerances of the mating threads through such processes and materials.

One option to reduce the complexity and/or cost is to produce the threaded collar from plastic, such as by injection molding a relatively hard plastic. As described below, however, it can be desirable to completely eliminate such plastics from the bottle, and the description below provides various embodiments of plastic free bottles that, for example, utilize silicone for the threaded collar that mates with the metal threads of the container portion.

In some embodiments, the plastic free bottles disclosed herein include a metal container portion that comprises metal threads. The plastic free bottles further include an annular threaded collar portion that is produced from a softer and/or more elastic material, such as silicone. Utilizing such softer and/or more elastic material for threads that engage the metal threads of the container portion can introduce some complexities, however, which are addressed in various ways in various embodiments disclosed herein. For example, some embodiments utilize a significantly thicker cross-sectional area near the threads and/or near the annular ridge portion that engages the mouthpiece than for a steel threaded collar. As another example, some embodiments include a stiffening member, such as an annular ring, which is desirably formed from a material having a higher hardness and/or lower elasticity than the silicone. The stiffening member may be positioned around a threaded region of the silicone collar and help to, for example, limit radial expansion of the silicone collar as the silicone collar is tightened on to the metal container portion.

According to some embodiments, a bottle includes: a container portion including a neck portion that includes a first thread adjacent a lip, the lip defining an opening that enables access to an internal cavity of the container portion, wherein at least the first thread of the neck portion of the container portion includes stainless steel; a silicone mouthpiece portion including a mouth interface portion and a lower sealing surface or portion sized to mate with the lip of the neck portion of the container portion; and a collar including a silicone main body and a stainless steel annular support ring, wherein the silicone main body of the collar includes: an annular wall; an annular ridge portion extending radially inward from a top or upper portion of the annular wall; and a second thread extending radially inward from the annular wall, the second thread configured to threadingly engage the first thread of the neck portion of the container portion in order to cause the annular ridge portion to force the lower sealing surface or portion of the silicone mouthpiece portion against the lip of the neck portion of the container portion, to seal the silicone mouthpiece portion to the container portion, and wherein the stainless steel annular support ring is positioned around and radially outward of the second thread in order to resist expansion of the annular wall in response to the second thread being tightened against the first thread.

In some embodiments, the annular wall includes an annular recess around an outer surface thereof, and wherein the stainless steel annular support ring is positioned at least partially within the annular recess. In some embodiments, the stainless steel annular support ring is positioned within the annular wall. In some embodiments, the silicone main body of the collar includes a silicone material that is harder than a silicone material of the silicone mouthpiece portion. In some embodiments, the annular ridge portion of the silicone main body of the collar includes a first thickness, measured along a direction parallel to a central axis of the second thread, the stainless steel annular support ring includes a second thickness, measured along a direction perpendicular to the central axis of the second thread, and the first thickness is at least two times the second thickness. In some embodiments, the first thickness is at least three times the second thickness. In some embodiments, the annular wall includes a third thickness, measured along the direction perpendicular to the central axis of the second thread, and the third thickness is at least two times the second thickness. In some embodiments, the stainless steel annular support ring includes in inner surface that is positioned radially inward from an outer surface of the annular wall, and wherein the third thickness is a minimum thickness of the annular wall between the inner surface of the stainless steel annular support ring and the second thread.

According to some embodiments a bottle having a container portion and a mouthpiece portion includes: a body portion including: an annular wall having a top portion and an opposing bottom portion, wherein the bottom portion of the annular wall defines a bottom opening configured to receive the container portion; and a ridge portion extending inwardly from the top portion of the annular wall, wherein the ridge portion defines a top opening through which the mouthpiece portion can be inserted, wherein the body portion is configured to removably couple the mouthpiece portion to the container portion; and an annular support portion coupled to and extending circumferentially around the annular wall of the body portion, wherein the annular support portion is configured to resist radial expansion of the annular wall in response to the body portion being secured to the mouthpiece portion and to the container portion.

In some embodiments, the body portion further includes at least one thread extending inwardly from the annular wall, wherein the at least one thread is configured to engage a corresponding thread of the container portion to seal the mouthpiece portion to the container portion. In some embodiments, the body portion includes a silicone material, and the annular support portion includes a stainless steel material. In some embodiments, the body portion includes a material having a first hardness, and the annular support portion includes a material having a second hardness, wherein the second hardness is greater than the first hardness. In some embodiments, the body portion further includes a recessed channel formed into an exterior surface of the annular wall, wherein the recessed channel is configured to receive the annular support portion. In some embodiments, the annular support portion is embedded into the annular wall of the body portion. In some embodiments, the collar includes an anti-rotation feature configured to inhibit axial and/or rotational movement of the annular support portion relative to the body portion. In some embodiments, a thickness of the annular support portion, measured along a direction perpendicular to a central axis of the annular wall, is no more than 30% of a maximum thickness of the annular wall, measured along a direction perpendicular to the central axis of the annular wall. In some embodiments, a height of the annular support portion, measured along a direction parallel to a central axis of the annular wall, is at least 50% of a height of the body portion, measured along a direction parallel to the central axis of the annular wall. In some embodiments, a thickness of the ridge portion, measured along a direction parallel to a central axis of the annular wall, is at least 60% of a maximum thickness of the annular wall, measured along a direction perpendicular to the central axis of the annular wall.

According to some embodiments, a bottle includes: a container portion; a mouthpiece portion; and an annular portion configured to threadingly engage the container portion to seal the mouthpiece portion to the container portion, wherein the mouthpiece portion includes a first silicone material having a first hardness, and wherein the annular portion includes a second silicone material having a second hardness that is harder than the first hardness.

In some embodiments, the bottle further includes an annular support portion coupled to and extending circumferentially around the annular portion, wherein the annular support portion is configured to resist radial expansion of the annular portion. In some embodiments, the annular portion further includes a recessed channel formed into an exterior surface of the annular portion, wherein the recessed channel is configured to receive the annular support portion. In some embodiments, the container portion includes stainless steel. In some embodiments, a durometer of the first hardness is at least 5 less than a durometer of the second hardness on the Shore A scale. In some embodiments, a durometer of the first hardness is within a range of 60 to 70 on the Shore A scale, and a durometer of the second hardness is within a range of 70 to 80 on the Shore A scale. In some embodiments, a durometer of the first hardness is at least 50 on the Shore A scale, and a durometer of the second hardness is at least 65 on the Shore A scale. In some embodiments, a durometer of the second hardness on the Shore A scale is at least 10% greater than a durometer of the first hardness on the Shore A scale. In some embodiments, the annular portion includes a lip that defines an opening through which the mouthpiece portion can be inserted, the lip configured to compress a portion of the mouthpiece portion against the container portion to facilitate the seal. In some embodiments, the lip includes a thickness of at least 1.5 mm. In some embodiments, the lip includes a thickness of at least 2 mm. In some embodiments, the lip includes a thickness of at least 3 mm. In some embodiments, the lip includes a thickness of at least 4 mm. In some embodiments, the lip includes a thickness that is at least 5% of a diameter of the opening. In some embodiments, the lip includes a thickness that is at least 4% of a diameter of the opening. In some embodiments, the lip includes a thickness that is at least 3% of a diameter of the opening. In some embodiments, the lip includes a thickness that is at least 6% of a diameter of the opening. In some embodiments, the lip includes a thickness that is at least 7% of a diameter of the opening. In some embodiments, the lip includes a thickness that is at least 8% of a diameter of the opening. In some embodiments, the lip includes a thickness that is at least 9% of a diameter of the opening. In some embodiments, the lip includes a thickness that is at least 10% of a diameter of the opening. In some embodiments, the annular portion includes an annular wall from which the lip extends. In some embodiments, the annular wall includes a thickness of at least 1.5 mm. In some embodiments, the annular wall includes a thickness of at least 2 mm. In some embodiments, the annular wall includes a thickness of at least 3 mm. In some embodiments, the annular wall includes a thickness of at least 4 mm. In some embodiments, the annular wall includes a thickness that is at least 5% of a diameter of the opening. In some embodiments, the annular wall includes a thickness that is at least 4% of a diameter of the opening. In some embodiments, the annular wall includes a thickness that is at least 3% of a diameter of the opening. In some embodiments, the annular wall includes a thickness that is at least 6% of a diameter of the opening. In some embodiments, the annular wall includes a thickness that is at least 7% of a diameter of the opening. In some embodiments, the annular wall includes a thickness that is at least 8% of a diameter of the opening. In some embodiments, the annular wall includes a thickness that is at least 9% of a diameter of the opening. In some embodiments, the annular wall includes a thickness that is at least 10% of a diameter of the opening.

According to some embodiments, a collar for a bottle includes: an annular wall; a lip extending inwardly from a top portion of the annular wall, wherein the lip defines an opening through which a mouthpiece portion can be inserted; and at least one thread extending inwardly from the annular wall, wherein the at least one thread is configured to engage a corresponding thread of a container portion to seal the mouthpiece portion to the container portion, and wherein the annular wall, the lip, and the at least one thread each include a silicone material.

In some embodiments, the collar further includes an annular support portion coupled to and extending circumferentially around the annular wall, wherein the annular support portion is configured to resist radial expansion of the annular wall. In some embodiments, the annular support portion includes a stainless steel material. In some embodiments, the annular wall includes a material having a first hardness, and the annular support portion includes a material having a second hardness, wherein the second hardness is greater than the first hardness. In some embodiments, the collar further includes a recessed channel formed into an exterior surface of the annular wall, wherein the recessed channel is configured to receive the annular support portion. In some embodiments, a durometer of a hardness the silicone material is within a range of 70 to 80 on the Shore A scale. In some embodiments, a durometer of a hardness of the silicone material is at least 65 on the Shore A scale. In some embodiments, the lip includes a thickness of at least 1.5 mm. In some embodiments, the lip includes a thickness of at least 2 mm. In some embodiments, the lip includes a thickness of at least 3 mm. In some embodiments, the lip includes a thickness of at least 4 mm. In some embodiments, the lip includes a thickness that is at least 5% of a diameter of the opening. In some embodiments, the lip includes a thickness that is at least 4% of a diameter of the opening. In some embodiments, the lip includes a thickness that is at least 3% of a diameter of the opening. In some embodiments, the lip includes a thickness that is at least 6% of a diameter of the opening. In some embodiments, the lip includes a thickness that is at least 7% of a diameter of the opening. In some embodiments, the lip includes a thickness that is at least 8% of a diameter of the opening. In some embodiments, the lip includes a thickness that is at least 9% of a diameter of the opening. In some embodiments, the lip includes a thickness that is at least 10% of a diameter of the opening. In some embodiments, the annular wall includes a thickness of at least 1.5 mm. In some embodiments, the annular wall includes a thickness of at least 2 mm. In some embodiments, the annular wall includes a thickness of at least 3 mm. In some embodiments, the annular wall includes a thickness of at least 4 mm. In some embodiments, the annular wall includes a thickness that is at least 5% of a diameter of the opening. In some embodiments, the annular wall includes a thickness that is at least 4% of a diameter of the opening. In some embodiments, the annular wall includes a thickness that is at least 3% of a diameter of the opening. In some embodiments, the annular wall includes a thickness that is at least 6% of a diameter of the opening. In some embodiments, the annular wall includes a thickness that is at least 7% of a diameter of the opening. In some embodiments, the annular wall includes a thickness that is at least 8% of a diameter of the opening. In some embodiments, the annular wall includes a thickness that is at least 9% of a diameter of the opening. In some embodiments, the annular wall includes a thickness that is at least 10% of a diameter of the opening.

According to some embodiments, a bottle includes: a stainless steel container portion having a threaded neck portion; and a one-piece silicone mouthpiece portion including: an annular portion configured to threadingly engage the stainless steel container portion; and a spout extending upward from the annular portion.

In some embodiments, the bottle further includes an annular support portion coupled to and extending circumferentially around the annular portion of the one-piece silicone mouthpiece portion, wherein the annular support portion is configured to resist radial expansion of the annular portion of the one-piece silicone mouthpiece portion when threadingly engaged to the stainless steel container portion. In some embodiments, the one-piece silicone mouthpiece portion includes a material having a first hardness, and the annular support portion includes a material having a second hardness, wherein the second hardness is greater than the first hardness. In some embodiments, the one-piece silicone mouthpiece portion further includes a recessed channel formed into an exterior surface of the annular portion, wherein the recessed channel is configured to receive the annular support portion.

According to some embodiments, a bottle includes: a container portion including a neck portion that includes a first thread adjacent a first lip, the first lip defining an opening that enables access to an internal cavity of the container portion; a mouthpiece portion including a mouth interface portion and a second lip; and a collar including a main body and an annular support portion, wherein the main body of the collar includes a silicone material that forms: an annular wall; a third lip extending radially inward from a top portion of the annular wall; and a second thread extending radially inward from the annular wall, the second thread configured to threadingly engage the first thread of the neck portion of the container portion in order to cause the third lip to force the second lip of the mouthpiece portion against the first lip of the neck portion of the container portion, to seal the mouthpiece portion to the container portion, wherein the annular support portion is positioned around and radially outward of the second thread in order to resist expansion of the annular wall in response to the second thread being tightened against the first thread, and wherein the annular support portion includes a material having an elastic modulus that is at least five times an elastic modulus of the silicone material of the main body of the collar.

In some embodiments, the annular support portion includes stainless steel. In some embodiments, the annular support portion includes a material having an elastic modulus that is at least 100 times the elastic modulus of the silicone material of the main body of the collar. In some embodiments, at least the first thread of the neck portion of the container portion includes stainless steel. In some embodiments, the annular wall includes an annular recess around an outer surface thereof, and wherein the annular support portion is positioned at least partially within the annular recess. In some embodiments, the annular support portion is positioned within the annular wall. In some embodiments, the silicone material of the main body of the collar includes a higher hardness than a silicone material of the mouthpiece portion. In some embodiments, the third lip of the main body of the collar includes a first thickness, measured along a direction parallel to an axis of the second thread, the annular support portion includes a second thickness, measured along a direction perpendicular to the axis of the second thread, and the first thickness is at least two times the second thickness. In some embodiments, the first thickness is at least three times the second thickness. In some embodiments, the annular wall includes a third thickness, measured along the direction perpendicular to the axis of the second thread, and the third thickness is at least two times the second thickness. In some embodiments, the annular support portion includes in inner surface that is positioned radially inward from an outer surface of the annular wall, and wherein the third thickness is a minimum thickness of the annular wall between the inner surface of the annular support portion and the second thread. For purposes of this summary, certain aspects, advantages, and novel features of the embodiments are described herein. It is to be understood that not necessarily all such advantages may be achieved in accordance with any particular embodiment. Thus, for example, those skilled in the art will recognize that the embodiments may be embodied or carried out in a manner that achieves one advantage or group of advantages as taught herein without necessarily achieving other advantages as may be taught or suggested herein.

BRIEF DESCRIPTION OF THE DRAWINGS

The foregoing and other features, aspects and advantages of the embodiments are described in detail below with reference to the drawings of various embodiments, which are intended to illustrate and not to limit the disclosure. The drawings comprise the following figures in which.

DETAILED DESCRIPTION OF THE EMBODIMENTS

Although several embodiments, examples and illustrations are disclosed below, it will be understood by those of ordinary skill in the art that the disclosure extends beyond the specifically disclosed embodiments, examples and illustrations, and includes other uses of the embodiments and obvious modifications and equivalents thereof. Embodiments are described with reference to the accompany figures, wherein like numerals refer to like elements throughout. The terminology used in the description presented herein is not intended to be interpreted in any limited or restrictive manner simply because it is being used in conjunction with a detailed description of certain specific embodiments. In addition, embodiments described herein can comprise several novel features and no single feature is solely responsible for its desirable attributes or is essential to practicing the inventions herein described.

As indicated in reports by the FDA and others, it is advantageous to reduce plastic compounds and toxins exposure to humans, in particular infants, toddlers, and children, as well as adults. To reduce such plastic compounds and toxins exposure, it can be beneficial to substitute the use of plastic bottles or containers that may be laden with various toxins, with a fluid storage and delivery device that contains no plastic. Such a plastic-free device can also be reusable, thereby eliminating or reducing the need for petroleum-based plastic bottles that generally contribute to a massive waste problem. Additionally, the use of the plastic-free fluid storage and delivery devices disclosed herein can also help prevent allergy attacks in those individuals that are allergic to the compounds in plastic bottles and containers.

To prevent and/or reduce an individual's exposure to plastic compounds and toxins, fluids or other substances to be consumed by humans should not come into contact with storage and delivery devices containing plastic compounds and toxins because such containers can leach plastic compounds and toxins into the fluid. Accordingly, the fluid storage and delivery devices disclosed herein desirably contain no, or substantially no, plastic compounds and toxins. Therefore, the leaching of plastic compounds and toxins into the fluid being stored in the container is eliminated.

Figure 1A:
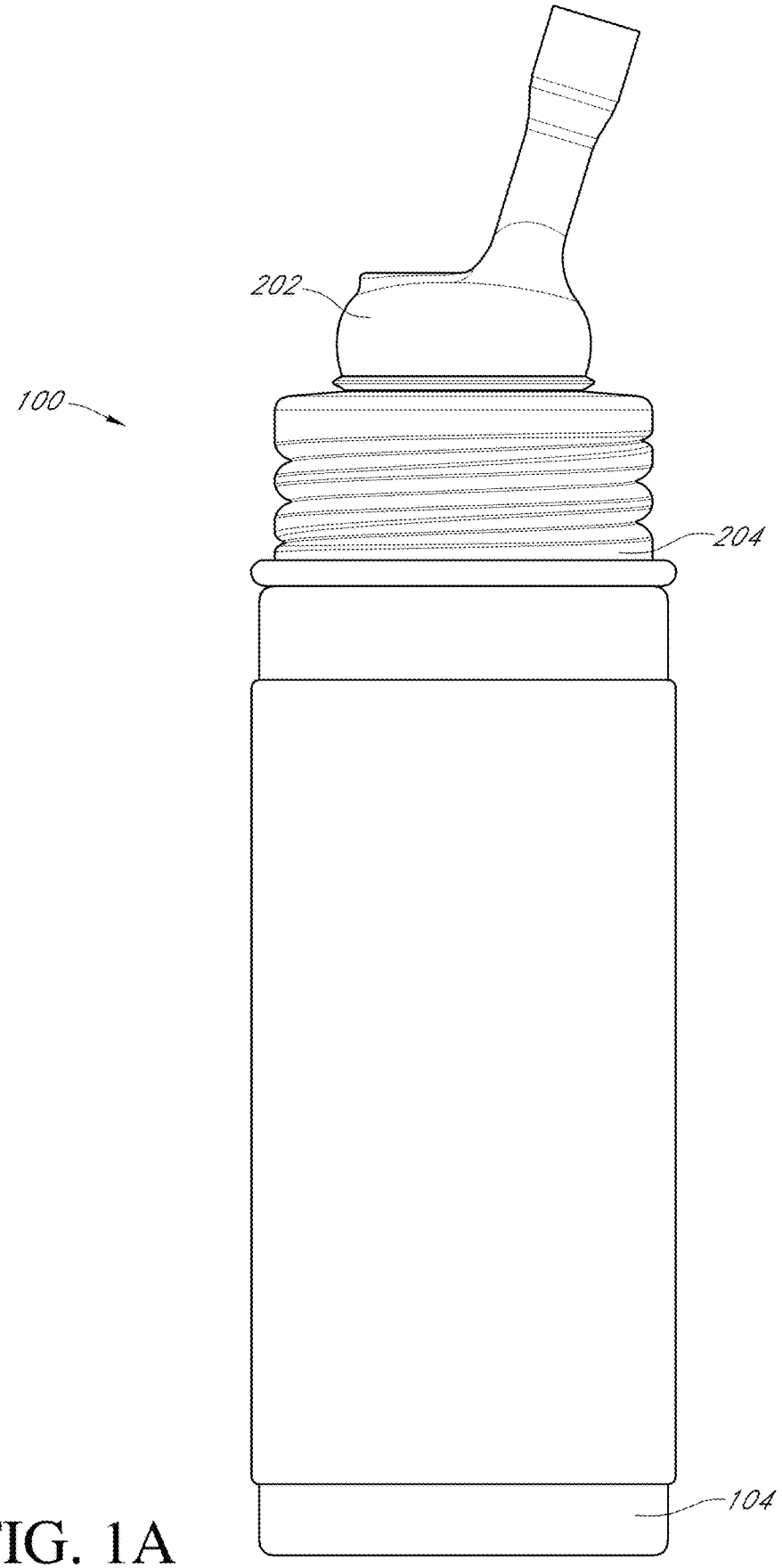
FIG. 1A is a side view of an embodiment of a bottle with a stainless steel collar.
Figure 1B:
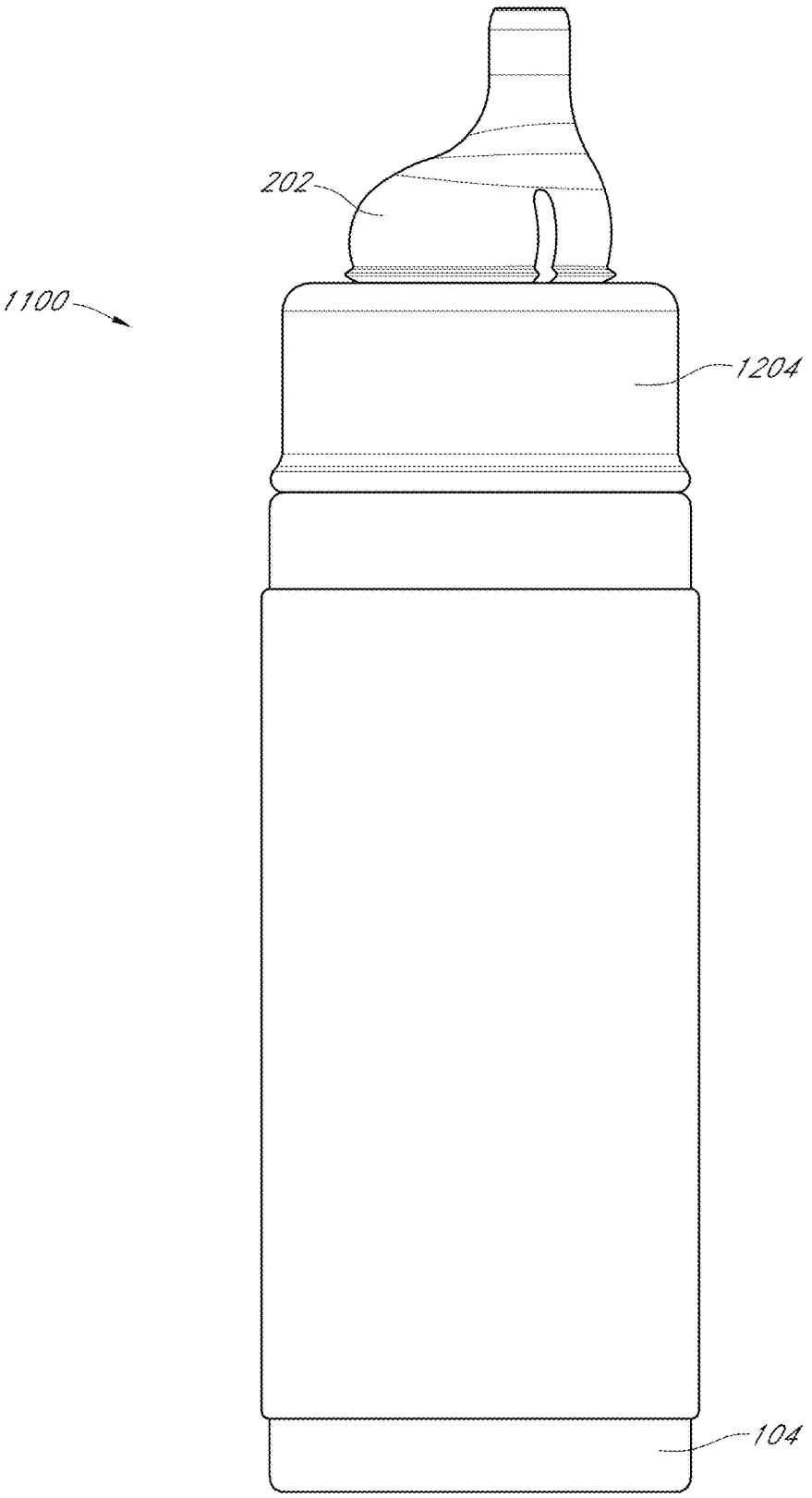
FIG. 1B is a side view of an embodiment of a bottle with a silicone collar.
Figure 2B:
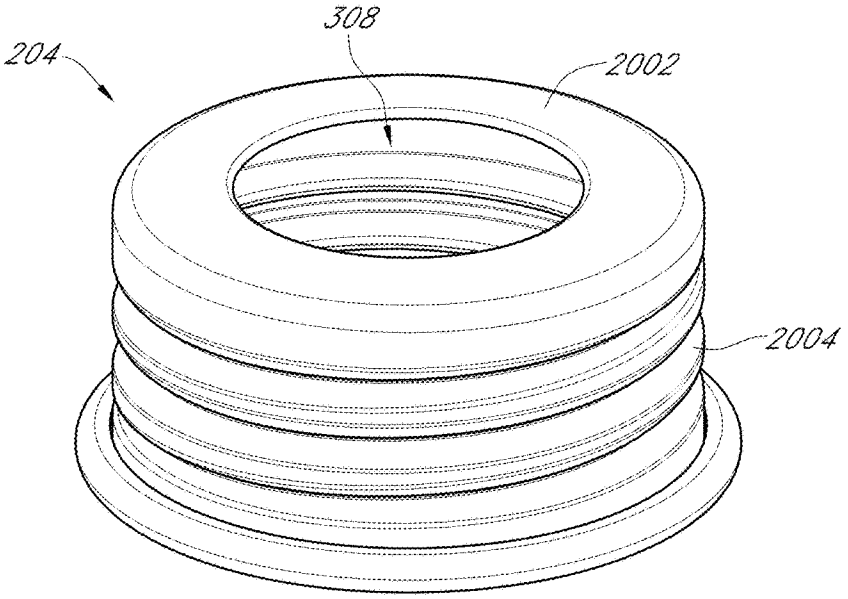
FIGS. 2A-2D include top and bottom perspective views of the collars of the embodiments of FIGS. 1A and 1B, with FIGS. 2A and 2C being top and bottom perspective views, respectively, of the silicone collar of FIG. 1B, and FIGS. 2B and 2D being top and bottom perspective views, respectively, of the stainless steel collar of FIG. 1A.
Figure 2A:
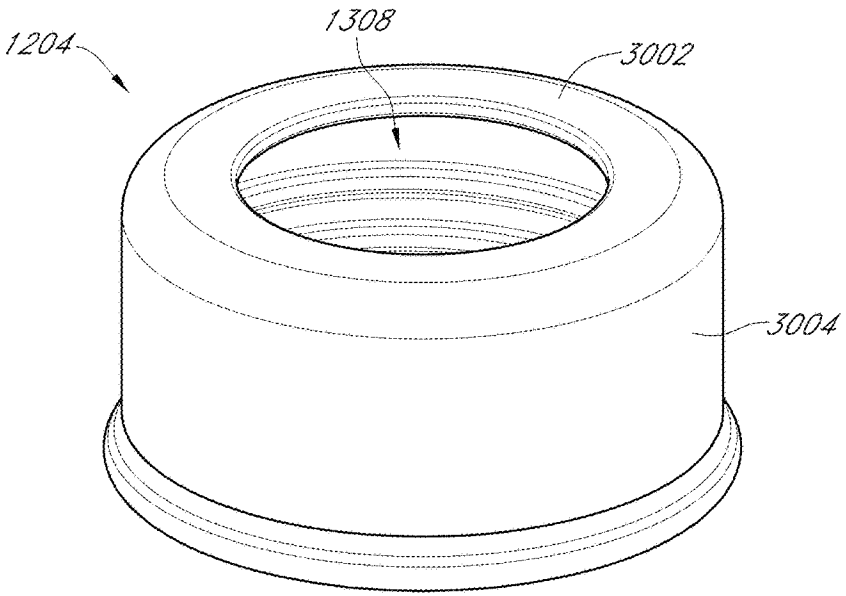
Figure 2D:
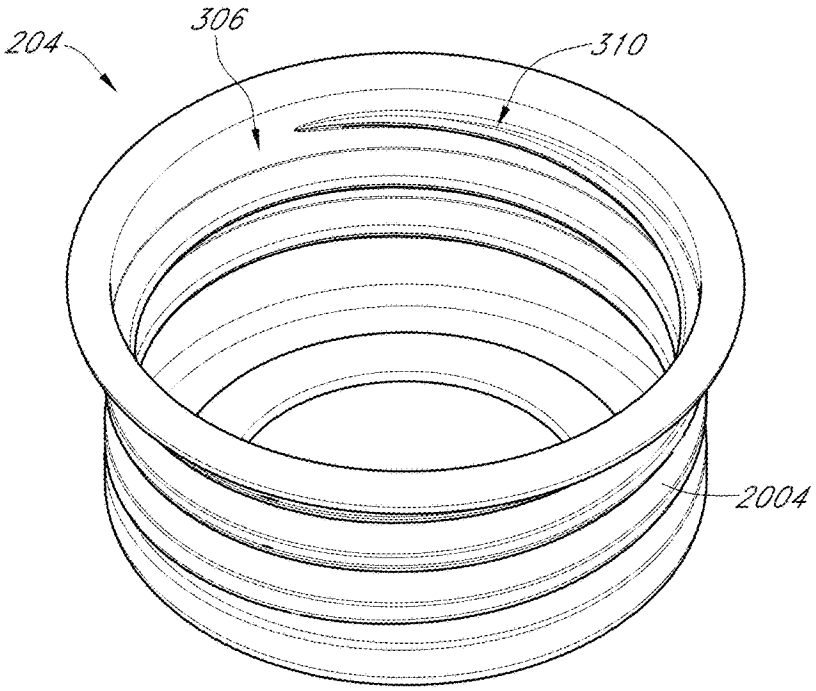
Figure 2C:
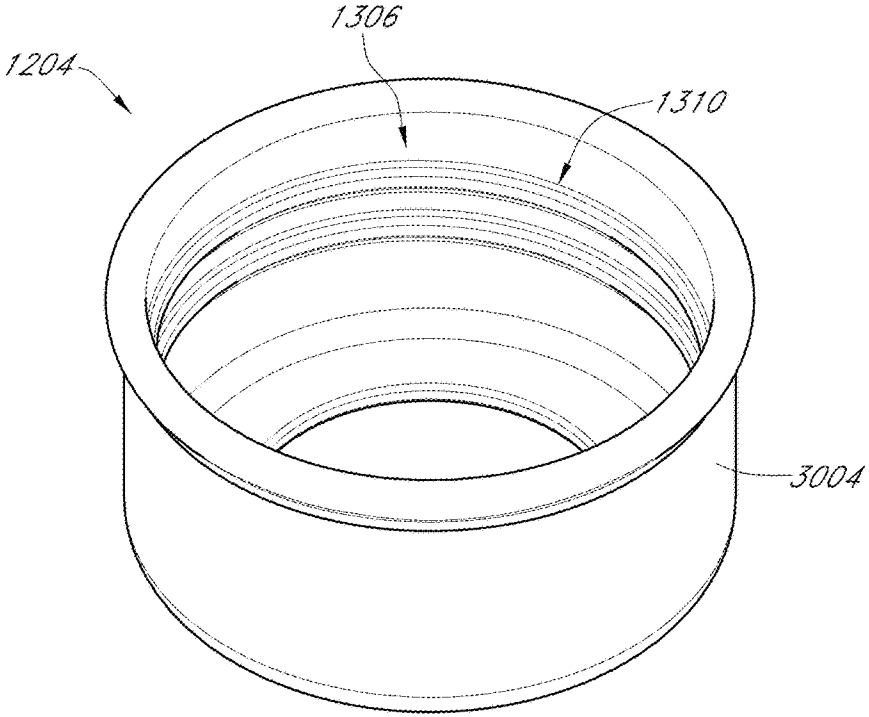

FIGS. 1A and 1B illustrate two examples of fluid storage and delivery devices or bottles 100 and 1100. Each of the bottles 100, 1100 comprises a container portion 104, a mouthpiece portion 202, and an annular portion or collar 204, 1204 that couples to and seals the mouthpiece portion 202 to the container portion 104. FIG. 2A is a top perspective view of the silicone collar 1204 of FIG. 1B. FIG. 2C is a bottom perspective view of the silicone collar 1204 of FIG. 1B. As shown in FIGS. 2A and 2C, the silicone collar 1204 can include a lip or ridge portion 3002, an opening 1308, and an annular wall 3004. FIG. 2B is a top perspective view of the stainless steel collar 204 of FIG. 1A. FIG. 2D is a bottom perspective view of the stainless steel collar 204 of FIG. 1A. As shown in FIGS. 2B and 2D, the stainless steel collar 204 can include a lip or ridge portion 2002, an opening 308, and an annular wall 2004.

Figure 3A:
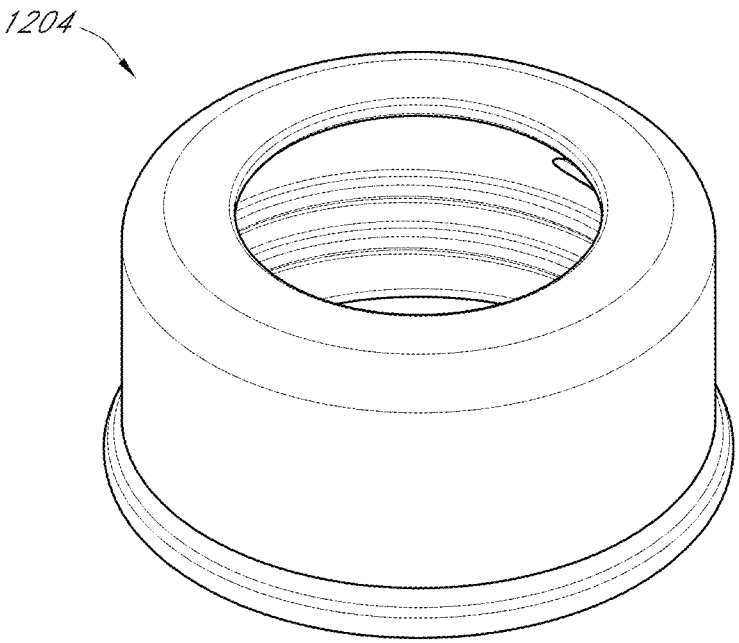
FIG. 3A is another top perspective view of the silicone collar of FIG. 1B.

With reference to FIG. 1A, the bottle 100 of FIG. 1A is similar to the bottle 100 shown in FIG. 2 of U.S. Pat. No. 8,573,436 (referred to herein as "the '436 patent"), titled PLASTIC-FREE DEVICE FOR FLUID STORAGE AND DELIVERY, and the same or similar reference numbers are used to refer to the same or similar components. For example, the container portion 104 is similar to the container portion 104 of the '436 patent, except that the container portion 104 of bottle 100 of present FIG. 1A is somewhat taller and of an insulated double wall design instead of a single wall design. As another example, the mouthpiece portion 202 of bottle 100 of present FIG. 1A comprises a different mouth interface (in this case a straw spout) than the mouthpiece portion 202 of FIG. 2 of the '436 patent (in that case a nipple). The annular portion or collar 204 of the bottle 100 of present FIG. 1A is the same as or similar to the design of the annular portion 204 of FIG. 2 of the '436 patent. Further, the configuration of how the annular portion 204 engages the container portion 104 and seals the mouthpiece portion 202 to the container portion 104 can be the same as or similar to as shown in FIG. 3A of the '436 patent. The '436 patent, attached to U.S. Provisional Patent Application No. 63/638,316, filed Apr. 24, 2024, as Appendix A, is also hereby incorporated by reference herein. Any of the embodiments disclosed herein may be used with the embodiments disclosed in the '436 patent, and any of the embodiments disclosed in the '436 patent may be modified to incorporate one or more features of the embodiments disclosed herein.

With reference to FIG. 1B, the bottle 1100 is similar to the bottle 100 of FIG. 1A, except that a different annular portion or collar 1204 is utilized. Additionally, the mouthpiece portion 202 of the bottle 1100 utilizes a different mouth interface than the mouthpiece portion 202 of bottle 100 (in this case, a sippy spout), but the features of the mouthpiece portion 202 of bottle 1100 that are not visible in FIG. 1B can be the same as or similar to the mouthpiece portion 202 of FIGS. 1A, 5A-5C, 7A-7B, and/or 8A-8B (and/or of the mouthpiece portion 202 shown in FIG. 3A of the '436 patent).

As described in the '436 patent, it can be desirable for the annular portion or collar 204 to be formed from stainless steel. For example, forming both the collar 204 and the container portion 104 from stainless steel can help to produce a durable bottle that will reduce the chances of leaching chemicals into fluids such as could be caused by using plastic for such components. As an alternative to the stainless steel collar 204 of the bottle 100, however, it can also be desirable to form the collar or annular portion, such as collar 1204 of bottle 1100, from silicone, such as food grade silicone. Although the annual portion 1204 is desirably formed from silicone, other materials may also or alternatively be used, such as other materials that are more elastic and/or softer than a typical steel or hard plastic.

One issue or difficulty with using stainless steel for the collar 204 is that it can be difficult to manufacture the threads of the collar 204 (see threads 310 of FIG. 2D) precisely enough to form a desirable fit with mating threads of the container portion 104. For example, if the surface finishes of the mating threads are not smooth enough and/or the threads fit too tightly, it can be difficult to screw the collar 204 onto and off of the container portion 104. Additionally, rotating the collar 204 onto and off of the container portion 104 may not be smooth (e.g., some grinding or stickiness may be felt while trying to tighten the threads), which can result in a suboptimal user experience. The silicone collars disclosed herein (e.g., collar 1204 of bottle 1100, and/or collars 504, 604, 704, 804, and/or 904 discussed below, and/or the like) can solve this problem. For example, because the silicone material that collar 1204 (and/or other collars disclosed herein) comprises and/or is formed from is desirably softer and/or more elastic than the stainless steel from which the container portion 104 is formed, the collar 1204 (and/or other collars disclosed herein) can be screwed on and off of the container portion 104 in a relatively smooth manner, even if there is some interference between the threads of the collar (see, e.g., threads 1310, 510, 610, 710, 810, or 910 of FIG. 2C, 3C, 4, 5C, 6B, 7B, 8B, 9B, 10B, or 11B) and the threads of the container portion 104 (see, e.g., threads 304 of FIG. 2 of the '436 patent, which may be the same as or similar to threads 304 of FIGS. 5B and 5C discussed below).

Other benefits of forming the collar 1204 (and/or other collars disclosed herein) from silicone (or from another material that is softer and/or more elastic than steel or hard plastics) include that the outer surface of the collar 1204 can be easier to grip with human hands, and that the collar 1204 may itself perform some sealing function between the collar 1204 and the container portion 104. For example, if a perfect seal is not formed between the mouthpiece portion 202 and the container portion 104 (such as due to an imperfection, wear, or a tear in the sealing features of the mouthpiece portion 202 and/or the container portion 104), in an embodiment that uses a stainless steel collar (such as collar 204 of the bottle 100), this might result in some fluid leaking out of the bottle through the non-watertight space between the annular portion 204 and container portion 104. In an embodiment such as the bottle 1100, however, some portions of the annular portion 1204 and/or other annular portions or collars disclosed herein (such as the threads 1310 or 510, the annular wall 3004, 516, 616, 716, 816, 916 adjacent the threads 1310 or 510, 610, 710, 810, or 910 and/or an inner portion of the lip or ridge portion 3002, 512, 612) may form a watertight seal against a portion of the container portion 104, thus reducing or eliminating such leakage. Such a feature is not a requirement of all embodiments of the present disclosure, however.

One potential difficulty in manufacturing a collar out of silicone (such as the collar 1204) is that the silicone is more elastic than steel, and thus stresses introduced to the collar 1204 when tightening the collar 1204 onto the container portion 104 to seal the mouthpiece portion 202 to the container portion 104 would tend to the deform portions of the collar 1204 more than the stainless steel collar 204 would be deformed if the collars were of the same mechanical dimensions and design. In view of this, the collar 1204 (and other collars disclosed herein) utilizes some different design elements and/or dimensions than used with the collar 204. For example, with reference to FIG. 3B, it can be seen that in this embodiment the lip or ridge portion 3002 (e.g., inwardly extending annular ridge or annular ridge portion) comprises a thickness T3 of approximately 2 mm, which is thicker than the lip or ridge portion 2002 of collar 204. This thicker lip 3002 can help to facilitate a watertight seal with the mouthpiece portion 202, without overly stretching or deforming the collar 1204. Similarly, with continued reference to FIG. 3B, the collar 1204 comprises an annular wall 3004 that comprises a thickness T1 of approximately 2 mm (and which is also thicker than the annular wall of stainless steel collar 204). This thicker wall 3004 can also help to facilitate a watertight seal with the mouthpiece portion 202, without overly stretching or deforming the collar 1204.

Figure 3C:
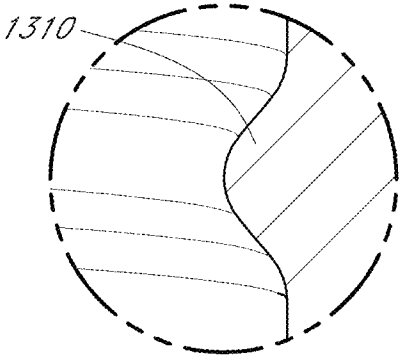
FIG. 3C is a detail view of a portion of the cross-sectional view of FIG. 3B.
Figure 3B:
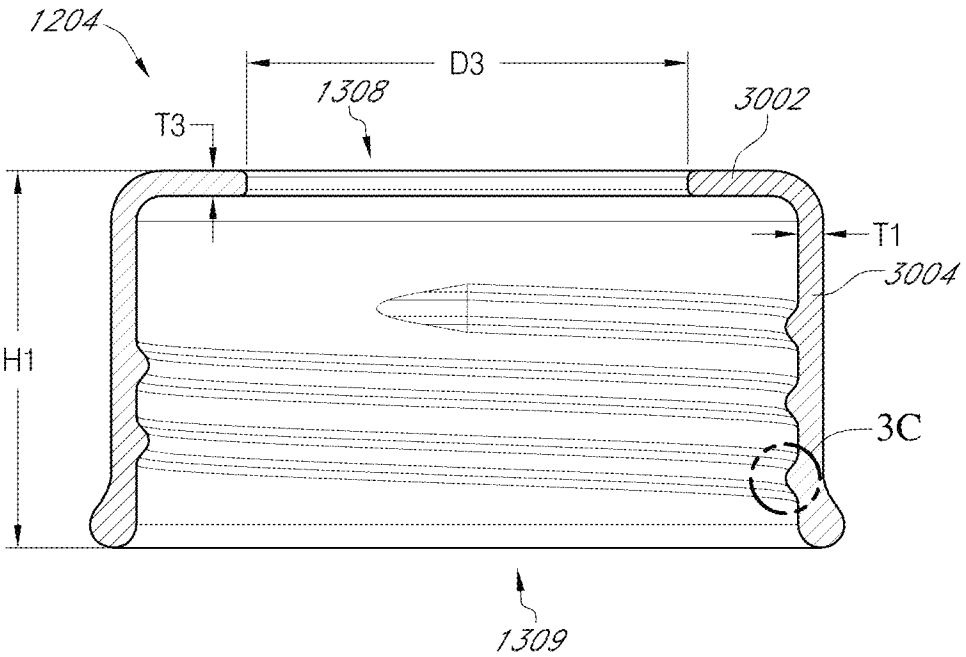
FIG. 3B is a cross-sectional view of the silicone collar of FIG. 1B.

With continued reference to FIG. 3B, and also to the detail view of FIG. 3C, the specific configuration of the threads 1310 of collar 1204 are shown. The threads 1310 may be similar in design to the threads 310 of the stainless steel collar 204, but alternatively may also be different. For example, as can be seen in the side-by-side views of FIGS. 2C-2D, the threads 1310 of the silicone collar 1204 are desirably somewhat smaller than the threads 310 of the stainless collar 204. One reason for this is that, due to the elasticity of the silicone collar 1204, the threads 1310 (and/or threads of other silicone collars disclosed herein) do not necessarily need to be as closely fitting to the corresponding threads of the container 104 in order to create a sufficiently tight but also smoothly fitting threaded engagement.

It should be noted that the specific dimensions discussed above with reference to FIGS. 3B and 3C are merely examples, and other dimensions may be used. For example, although in this embodiment the lip 3002 and wall 3004 are both shown as comprising approximately a 2 mm thickness (e.g., dimensions T3 and T1), other embodiments may comprise smaller or larger thicknesses, and some embodiments may utilize a larger thickness for the lip than the wall or may utilize a larger thickness for the wall than the lip. In some embodiments, the lip 3002 and/or the wall 3004 may comprise a thickness T3 and/or T1 of at least 1.5, 2, 2.5, 3, 3.5, or 4 mm. In some embodiments, the thickness of the lip 3002 and/or the wall 3004 may be described as a ratio of a diameter D3 of opening 1308. For example, in the embodiment shown in FIG. 3B, the thicknesses of the lip 3002 (T3) and wall 3004 (T1) are approximately 6% of the diameter D3 of opening 1308. In some embodiments, the thicknesses of the lip 3002 (T3) and/or the wall 3004 (T1) are at least 5%, 4%, 3%, 6%, 70%, 80%, 9%, or 10% of the diameter D3 of opening 1308. In some embodiments, the collar 1204 can have a height H1. In some embodiments, the values of thickness T1, thickness T3, and height H1 of the collar 1204 can be the same or similar to the values of thickness T1, thickness T3, and height H1 of the collar 504 as described below.

Although it can be desirable for both the mouthpiece portion 202 and the collar 1204 to comprise or be formed from silicone, it can also be desirable to form these two components from different silicone materials having different levels of hardness. For example, using a softer silicone for the mouthpiece portion 202 may provide better sealing and/or a better feel in the user's mouth, whereas using a harder silicone for the collar 1204 may provide for better structural integrity when tightening the collar 1204 to the container 104.

For example, it can be desirable for the silicone of the collar 1204 (and/or other collars disclosed herein, including collars 504, 604, 704, 804, and/or 904 discussed below) to be a harder silicone than the silicone of the mouthpiece portion 202. In some embodiments, the harnesses of the silicone materials can be defined on the Shore A scale, and a durometer of the silicone material for the mouthpiece portion 202 can be at least 5 less than the durometer of the silicone material for the collar (e.g., collar 1204, 504, 604, 704, 804, 904, and/or the like). In some embodiments, it can be desirable for the mouthpiece portion 202 to comprise a silicone material having a durometer within a range of 60 to 70 on the Shore A scale, and for the collar 1204 (and/or collar 504, 604, 704, 804, 904, and/or the like) to comprise a silicone material having a durometer within a range of 70 to 80 on the Shore A scale. In some embodiments, it can be desirable for the mouthpiece portion 202 to comprise a silicone material having a durometer of at least 50 on the Shore A scale, and for the collar 1204 (and/or collar 504, 604, 704, 804, 904, and/or the like) to comprise a silicone material having a durometer of at least 65 on the Shore A scale. In some embodiments, it can be desirable for the collar 1204 (and/or collar 504, 604, 704, 804, 904, and/or the like) to comprise a silicone material having a durometer that is at least 10% greater than the durometer of the silicone material of the mouthpiece portion 202 on the Shore A scale.

Although it can be desirable to form the mouthpiece portion 202 and collar 1204 (and/or collar 504, 604, 704, 804, 904, and/or the like) both from silicone, but each having a different hardness, it can also be desirable in some embodiments to combine the mouthpiece portion 202 and collar 1204 (and/or collar 504, 604, 704, 804, 904, and/or the like) into a single body. For example, a single combined collar 1204 (and/or collar 504, 604, 704, 804, 904, and/or the like) and mouthpiece portion 202 may be molded out of silicone that is the same or similar durometer as the individual mouthpiece portion 202, the same or similar durometer as the collar 1204 (and/or collar 504, 604, 704, 804, 904, and/or the like), or some durometer between those values. Combining the mouthpiece portion 202 and collar 1204 (and/or collar 504, 604, 704, 804, 904, and/or the like) into a single silicone part can be advantageous, for example, because production and assembly may be simplified, less potential leak paths may be present, the thicknesses of the lip 3002, 512 and/or the wall 3004, 516, 716, 816, 916 may not need to be as thick as when the collar 1204 is formed as a single or separate part, and/or the like.

Figure 4:
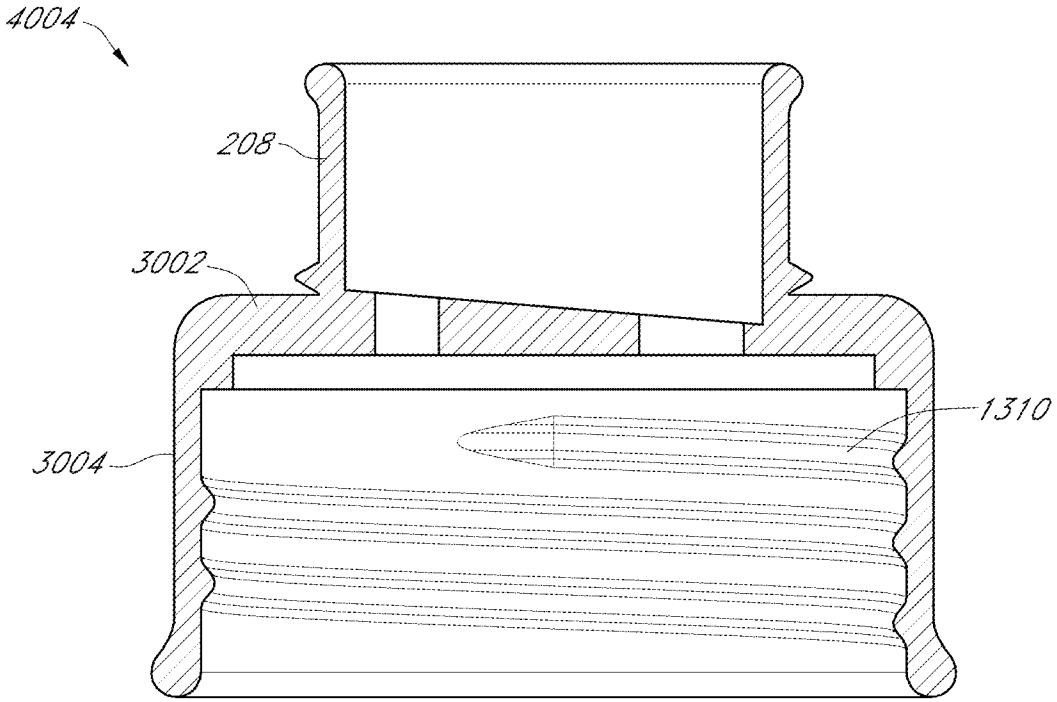
FIG. 4 is a cross-sectional view of a one-piece silicone mouthpiece portion including a threaded annular portion and a spout extending upward from the annular portion.

A combined configuration may be particularly beneficial for mouthpieces that do not require that a user squeeze or suck on the mouthpiece. For example, both of the mouthpiece portions 202 shown in FIGS. 1A and 1B desirably include integrated valves that require a user to bite down and/or suck on a portion of the mouthpiece in order to transfer fluid from the container portion 104. However, some embodiments of mouthpiece portions may be more like a spout, which have, for example, an annular ring that a user places their mouth on, and the user simply tips the bottle over to receive liquid from the container portion 104. One example of such a mouthpiece is shown in U.S. Design Pat. No. D750,490 (referred to herein as "the '490 patent"), titled FLUID CONTAINER SPOUT, which is hereby incorporated by reference herein. FIG. 4 illustrates a cross-sectional view of such a one-piece silicone collar and mouthpiece part 4004, which combines a portion of the spout disclosed in the '490 patent with the collar 1204 of FIG. 3B. For example, as shown in FIG. 4, the combined collar and mouthpiece part 4004 includes an annular wall 3004, a ridge portion 3002, and a spout portion 208. Threads 1310 can be positioned on an interior surface of the annular wall 3004. The spout portion 208 can extend from the ridge portion 3002. With reference to FIG. 4, the annular wall 3004, ridge portion 3002, and spout portion 208 can all be formed as a single unitary piece.

In such an embodiment, it may be more acceptable, and in fact may be more desirable, to form the mouthpiece part 4004 using the same relatively harder durometer silicone that a separate annular portion 1204 (and/or 504, 604, 704, 804, 904, and/or the like) is formed from. For example, in some embodiments, a single integrated part may be formed from silicone having any durometer between, for example, 70 to 80 on the Shore A scale (although other durometers may also be used). An additional example embodiment of such a combined mouthpiece portion and spout is described below with reference to FIGS. 8A and 8B.

Silicone Collar with Steel Support Portion

As described above, a silicone collar can effectively be used with a more rigid bottle, such as a stainless steel bottle, particularly if the design of the silicone collar is such that certain dimensions are changed with respect to a steel collar (for example, increasing the thickness of the annular wall of the collar, increasing the thickness of the ridge or lip of the collar, and/or the like). Such structural changes can help to maintain the structural rigidity of the collar when installed on a bottle such that the collar works sufficiently to perform its functions of, for example, maintaining the mouthpiece portion in place and creating a watertight seal between the mouthpiece portion and the container portion of the bottle. In some embodiments of silicone collars, however, an additional support portion may be included-either along with the dimensional changes discussed above, or in lieu of the dimensional changes discussed above. For example, a stainless steel ring (e.g., an annular support portion, member, or ring), may be positioned around and/or embedded within the silicone collar. The stainless steel ring may have a higher hardness and/or lower elasticity than the silicone that forms the rest of the collar (or at least the threaded portion and/or annular wall portion of the collar). Accordingly, when the collar is tightened onto the mating threads of the container portion of the bottle, at least some of the forces generated by that tightening (e.g., by the hoop stress introduced into the annular wall of the collar, and/or the tendency of the silicone threads and annular wall to radially expand when tightened against the stiffer metal threads of the bottle) may be resisted by the stainless steel ring, and thus less deformation (such as less radial expansion of the outer diameter of the collar) may be experienced when tightening the collar to the container portion of the bottle. Additionally, in some embodiments, the annular support ring (e.g., annular support portion, annular support member, and/or the like) may also help to resist stretching of the silicone threads and annular wall along the axial direction during tightening). Various embodiments of such designs are described below with reference to FIGS. 5A-11B.

It should be noted that, although various embodiments described herein, including embodiments described above and below, are described with reference to portions of the collar comprising silicone and/or portions of the collar comprising stainless steel, the disclosure is not limited to these specific materials. For example, in each of the embodiments described below that is described with reference to portions of the collar comprising silicone, and a support portion or ring comprising stainless steel, various embodiments may use different materials. For example, the support portion or ring may comprise any other material that has a higher hardness and/or lower elasticity than the material that forms the annular wall and/or threads (such as, for example, other types of steel, aluminum, wood, plastic, and/or the like).

Further, although each of the embodiments described below positions the support portion or ring in a certain manner, such as around an outside of the silicone portion, embedded within the silicone portion, and/or the like, the disclosure is not limited to the specific positions of the support portion or ring described below, and one or more support portions or rings may be included in different areas, as long as they are positioned such that they can help to reduce the deformation and/or expansion of the threads and/or the annular wall of the silicone portion when tightened onto the threads of the container portion of the bottle.

Additionally, various embodiments described below are described with reference to using an annular ring as the support portion that helps to reduce deformation and/or expansion of the threads and/or the annular wall of the silicone portion when tightened onto the threads of the container portion of the bottle. The disclosure is not limited to such specific configurations, however, and other arrangements are envisioned. For example, more than one annular ring may be included (e.g., such as more than one positioned at different positions along a central axis of the collar), the support portion may be separated into multiple parts that are positioned at different angular locations around the central axis of the collar, and/or the like.

Figure 5A:
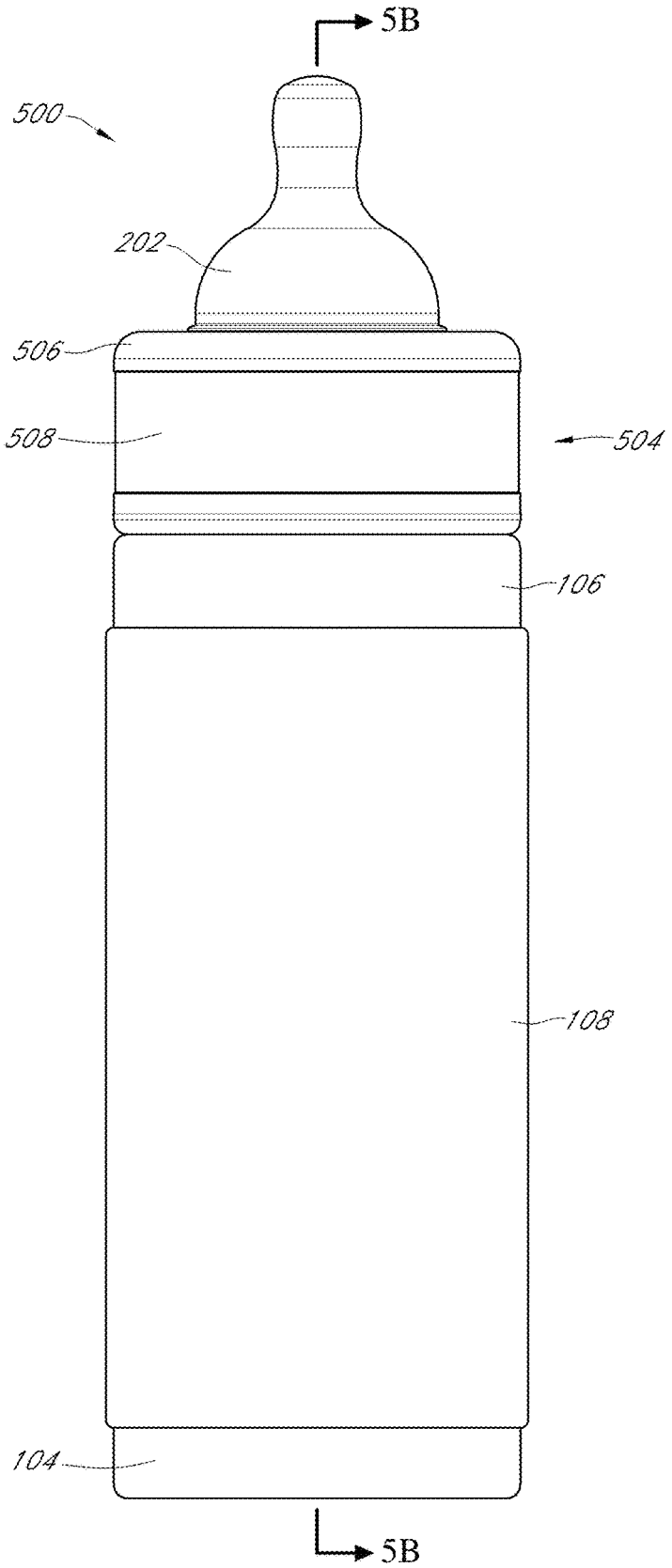
FIG. 5A is a side view of another example embodiment of a bottle with a silicone collar.

FIGS. 5A-6C illustrate an example embodiment of a fluid storage and delivery device or bottle 500 (and components thereof) that includes a support portion 508. FIG. 5A illustrates a side view of the assembled bottle 500. The bottle 500 of FIG. 5A can be similar to the bottles 100, 1100 shown in FIGS. 1A-1B, and the same or similar reference numbers are used to refer to the same or similar components. The bottle 500 can include one or more of the components or features of the bottles 100, 1100. For example, the bottle 500 includes a container portion 104, a mouthpiece portion 202, and an annular portion or collar 504. Collar 504 can couple to and seal the mouthpiece portion 202 to the container portion 104. As shown in FIG. 5A, collar 504 can include a body portion 506 (e.g., main body portion, threaded portion, threaded collar, and/or the like) and a support portion 508 (e.g., annular support portion, annular support member, ring, support ring, annular ring, annular support ring, compression ring, compression member, and/or the like). The body portion 506 can extend between and/or be coupled to the mouthpiece portion 202 and the container portion 104. The body portion 506 can removably couple the mouthpiece portion 202 to the container portion 104. The support portion 508 can be coupled to and extend circumferentially around the body portion 506. The support portion 508 can provide additional securement of the body portion 506 to the container portion and to the mouthpiece portion 202. For example, as discussed above, the support portion 508 may comprise a stainless steel ring that has a higher hardness and/or lower elasticity than the silicone of the body portion 506.

Figure 5B:
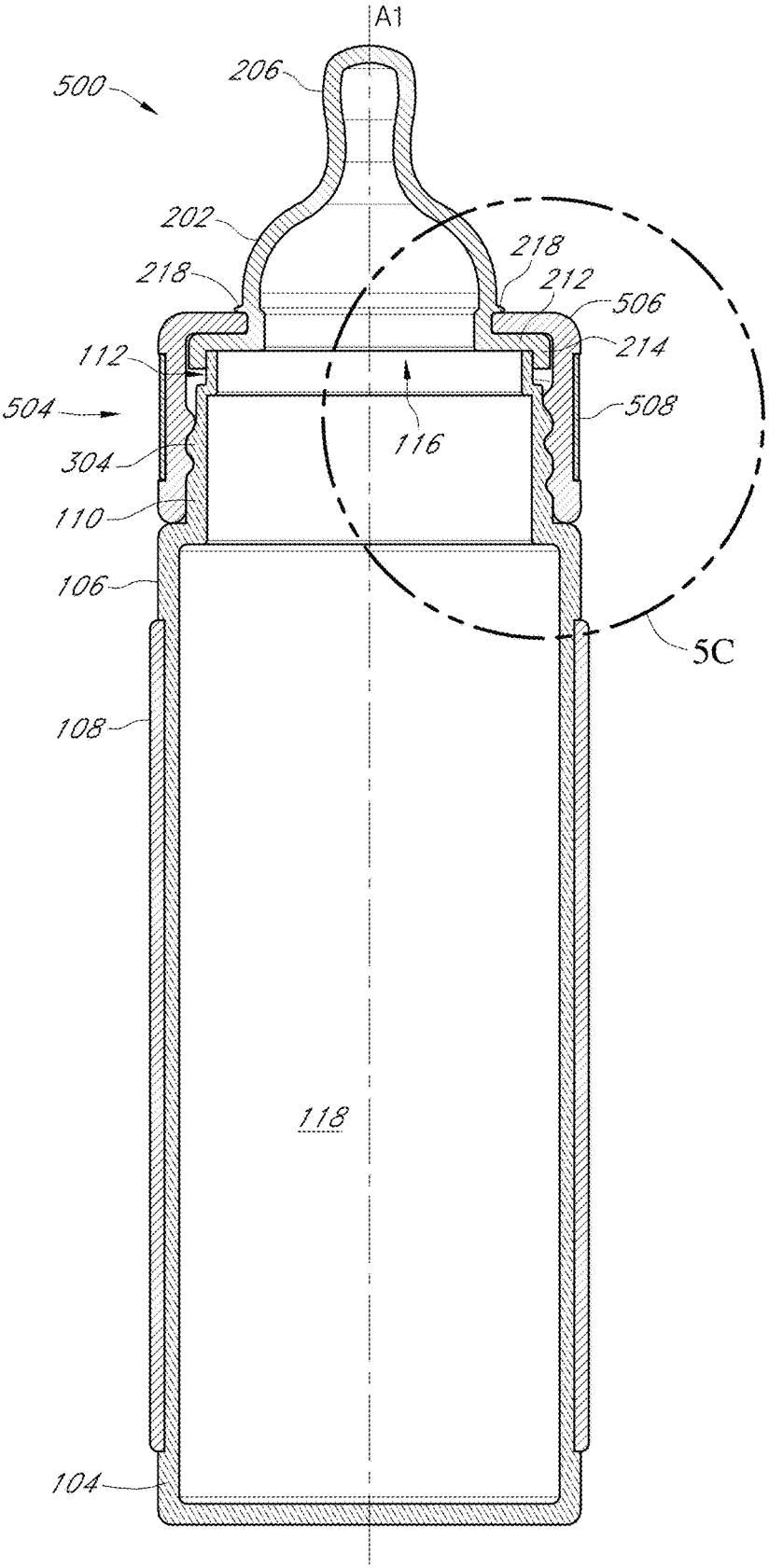
FIG. 5B is a cross-sectional view of the bottle of FIG. 5A.
Figure 5C:
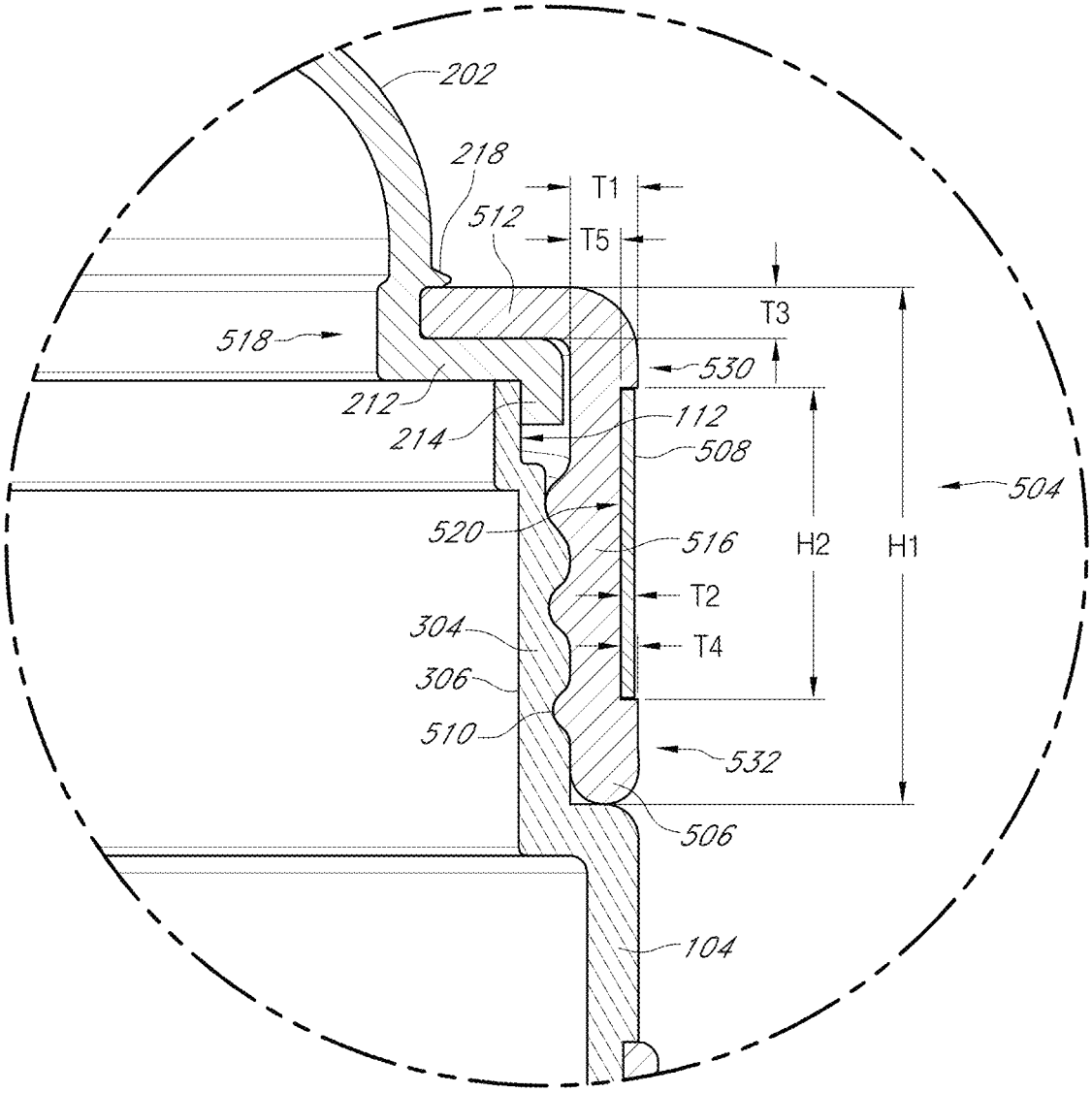
FIG. 5C is an enlarged view of a portion of the cross-sectional view of FIG. 5B.

FIG. 5B is a cross-sectional view of the bottle 500 of FIG. 5A, and FIG. 5C is an enlarged view of a portion of the cross-sectional view of FIG. 5B. With reference to FIGS. 5B-5C, the mouthpiece portion 202 can include a mouth interface portion 206 shaped for engagement by a user's mouth. In this embodiment, the mouth interface portion 206 comprises a nipple shape, but other shapes are possible. For example, the mouth interface portion 206 may include a straw, a spout (e.g., spout portion 208 of FIG. 7A), and/or the like. The mouthpiece portion 202 further comprises a lower sealing surface or portion that includes a lower lip 212 (e.g., lip, wall, annular sealing surface, and/or the like), and a wall 214 (e.g., lip, wall, annular surface, downward extending annular ridge, and/or the like) extending downward from lip 212. The nipple portion 206 can extend upward from the lower lip 212. The wall 214 can extend from the lower lip 212 in an opposite direction from the mouth interface portion 206. The mouthpiece portion 202 further comprises a retention feature 218 (e.g., protrusion, lip, ring, ridge, and/or the like) extending annularly around the mouthpiece portion and positioned spaced apart from and above the lip 212, in order to capture the lip or ridge 512 of the collar 504 between retention feature 218 and lip 212. As shown in FIGS. 5B-5C, the mouthpiece portion 202 can sit on and/or in the container portion 104 and the collar 504 can force the mouthpiece portion 202 and the container portion 104 into contact. In this way, a seal can be formed (e.g., between annular sealing surface 212 and step down or lip 112) such that liquid does not leak out of the bottle 500.

As shown in FIGS. 5B-5C, the body portion 506 (e.g., main body portion, threaded portion, threaded collar, and/or the like) of the collar 504 can contact the mouthpiece portion 202 and/or the container portion 104. The support portion 508 (e.g., annular support portion, annular support member, ring, support ring, annular ring, annular support ring, compression ring, compression member, and/or the like) can be coupled to and extend circumferentially around the body portion 506. The support portion 508 can, for example, help to secure the body portion 506 to the container portion 104 and/or the mouthpiece portion 202 to improve the seal formed between the body portion 506, the mouthpiece portion 202, and the container portion 104. In some embodiments, the support portion 508 can provide additional rigidity to the collar 504 (e.g., to help to keep the body portion 506 generally annular or cylindrical in shape and/or to reduce or limit radial and/or axial expansion of the body portion 506 when threads 510 of the collar 504 are tightened against mating threads 304 of the container portion 104). In this embodiment, the support portion 508 is a separate component from the body portion 506 and can be desirably relatively easily removed from and/or reinstalled onto the body portion 506. The disclosure is not limited to such a design, however, and other embodiments may have the support portion 508 permanently installed (e.g., such as by using adhesive, insert molding, interlocking features such as protrusions, and/or the like).

With reference to FIG. 5B, it should be noted that, for simplicity, the container portion 104 is depicted as having a single solid wall (element 106), and a silicone sleeve 108 positioned around the wall 106. The wall 106 may alternatively be of an insulated double wall design, instead of the single wall design, however. The wall 106 can define an internal cavity 118 for holding a fluid. The container portion 104 can additionally include a neck portion 110 extending upward from the wall 106. The neck portion 110 can define an opening 116 that enables access to the internal cavity 118. The neck portion 110 can include one or more threads 304 extending around an exterior surface of the neck portion 110 and generally aligned with and extending along central axis A1 of the bottle.

In an embodiment the threads 304 are pressed into the neck portion 110 such that the threads 304 extend radially outwardly. The threads can have a thickness or height of about 3.8 mm+/−0.25 mm. The thickness or height of the threads 304 can range between about 0.5 mm and about 5.0 mm. The width of the threads 304 can comprise a width of about 4 mm. The width of the threads 304 can range between about 1 mm and about 8 mm. In an embodiment, the threads 304 can comprise a pitch of about 6. The pitch of threads 304 can range between about 2 and about 8. The externally threaded neck portion 110 can be configured to allow the collar 504 to be fully seated on the container portion 104 in about 1⅓ revolutions of the collar 504. The number of revolutions needed to fully seat the collar 504 on the container portion 104 can range from about 1 revolution to about 3 revolutions. One of ordinary skill in the art will understand that 1 revolution is about 360°. By limiting the number of revolutions necessary to fully seat the collar 504 on the container portion 104, the user can quickly and simply couple the collar 504 to the container portion 104 and remove the collar 504 from the container portion 104. The neck portion 110 can be inline with, the same or different shape as or a different diameter than the wall 106. As shown, the wall 106 can form a shoulder that steps down the outer diameter to the neck portion 110. The neck portion 110 shown has a smaller outer diameter than the wall 106. In some embodiments, the neck portion 110 can include a further step down or lip 112 in outer diameter (see FIGS. 5B-5C). In some embodiments, the lip 112 can define the opening 116 of the container portion 104.

With reference to FIGS. 5B-5C, when the bottle 500 is assembled, the mouthpiece portion 202 can be positioned and compressed between the collar 504 and the container portion 104. Specifically, the lower lip or annular sealing surface 212 of the mouthpiece portion 202 can be positioned adjacent (e.g., below) the ridge portion 512 of the body portion 506 of the collar 504, and the ridge portion 512 of the collar 504 can force the annular sealing surface 212 against lip 112 of the container portion 104, thus creating a watertight seal between the mouthpiece portion 202 and the container portion 104.

The wall or ridge 214 of the mouthpiece portion can be interposed between the step down or lip 112 of the neck portion 110 of the container portion and wall 516 of the body portion 506. Such positioning of the wall 214 can, for example, help to align the mouthpiece with respect to the neck portion 110 of the container. In some embodiments, such positioning can also help in sealing the mouthpiece 202 to the container 104, such as by the collar 504 causing the wall 214 to at least partially compress against the neck portion 110 of the container 104 (e.g., the step down or lip 112 of the container). In some embodiments, the step down 112 can increase the amount of surface area contact between the container portion 104 and portion of the mouthpiece portion 202 that extends past the opening 116 of the container portion 104. The step down 112 can provide a better seal with a larger number of mouthpiece portions 202. With reference to FIGS. 5B-5C, it can be seen that in the illustrated configuration the collar 504 forces the mouthpiece portion 202 and the container portion 104 into contact and creates a seal. The step down 112 adjacent to the threads 304 can increase the biting action at the junction between the container portion 104 and the mouthpiece portion 202. These features both facilitate the use of different mouthpiece portions 202 and prevent the bottle 500 from leaking.

Figure 6B:
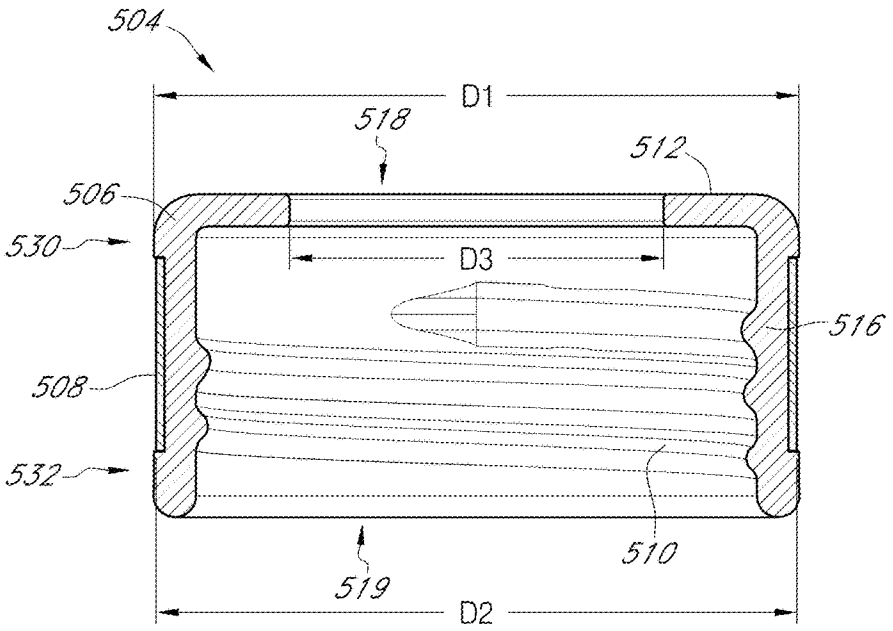
FIG. 6B is a cross-sectional view of the collar of FIG. 5A.
Figure 6A:
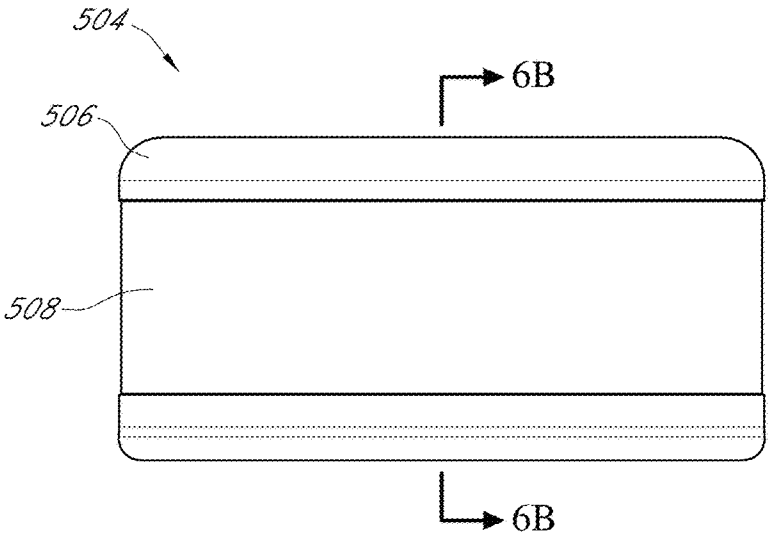
FIG. 6A is a side view of the collar of FIG. 5A.
Figure 6C:
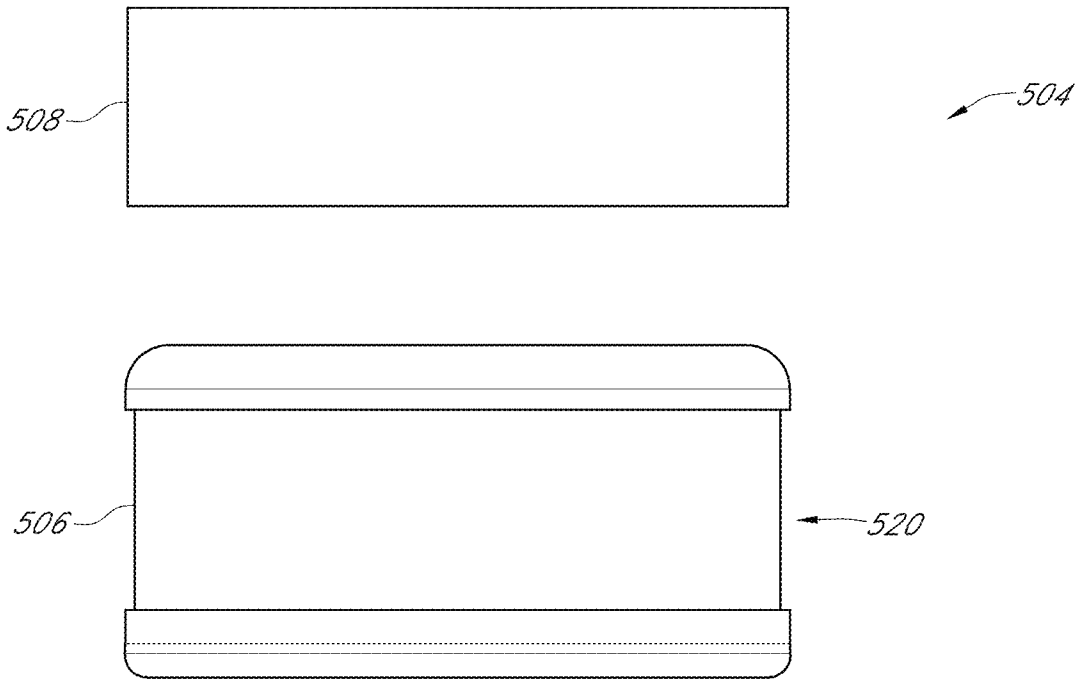
FIG. 6C is an exploded view of the collar of FIG. 5A.

FIGS. 6A-6C illustrate additional features of the collar 504 of FIGS. 5A and 5B. FIGS. 6A and 6B are side and cross-sectional views, respectively, of the collar 504 with the support portion 508 installed onto the main body 506. FIG. 6C is an exploded view, with the support portion 508 removed from the main body 506. With reference to FIGS. 5C and 6B, the body portion 506 can include a wall 516 (similar to wall 3004 of collar 1204), a lip or ridge portion 512 (e.g., an annular ridge portion similar to lip or ridge portion 3002 of collar 1204), a top opening 518 (similar to top opening 1308 of collar 1204), and a bottom opening 519 (similar to bottom opening 1309 of collar 1204). Like collar 1204, the body portion 506 can have a height H1 and an outer diameter D1, and the wall 516 can extend circumferentially around the body portion 506 such that it forms a substantially annular shape. Accordingly, the wall 516 can be an annular wall.

With continued reference to FIGS. 5C and 6B, the wall 516 can extend between a top or upper portion 530 and an opposing bottom or lower portion 532. The bottom portion 532 of the wall 516 can define a bottom opening 519. The bottom opening 519 can be shaped and sized to receive the neck portion 110 of the container portion 104. At least a portion of the wall 516 can have a thickness T1 (excluding the thickness contributed by any threads 510). The thickness T1 can be a maximum thickness of the wall 516 (e.g., measured perpendicular to central axis A1). A recessed channel 520 (e.g., channel, groove, slot, depression, and/or the like) can be formed into the wall 516. The recessed channel 520 can include a thickness T4 (e.g., measured perpendicular to the axis A1) and a height H2 (e.g., measured parallel to the axis A1). Along the height H2 of the recessed channel 520, the wall 516 can have a thickness T5 (e.g., measured perpendicular to the axis A1). Thickness T5 can be a minimum thickness of the wall 516. The sum of thickness T4 and thickness T5 can be equal to thickness T1. The recessed channel 520 can be sized and shaped to receive the support portion 508. In some embodiments, as shown in FIG. 5C, the depth of the channel 520 is sufficient such that the support portion 508 will be flush with or below the outermost surface of wall 516. In other embodiments, the support portion may extend radially outward beyond the outermost surface of wall 516.

With continued reference to FIG. 5C, the ridge or lip portion 512 can extend inwardly from the top portion of the wall 516. As shown in FIG. 5C, the ridge portion 512 can extend along a plane that is substantially perpendicular to the height dimension H1 of the body portion 506 (and/or to the axis A1). In some embodiments, the ridge portion 512 may extend at least partially at a non-perpendicular angle, however). The ridge portion 512 of the body portion 506 can have a thickness T3 (e.g., measured parallel to the axis A1 in an embodiment that has the ridge portion 512 extending along a plane perpendicular to the axis). The ridge portion 512 can define the top opening 518. The top opening 518 can have a diameter D3. As shown in FIGS. 5B-5C, the mouthpiece portion 202 can be inserted into and extend through the top opening 518. The body portion 506 can also include threads 510 (similar to threads 1310 of collar 1204) positioned on and extending radially inward from an interior surface of the wall 516. The threads 510 on the interior surface of the body portion 506 can interface with corresponding threads 304 on the container portion 104 to secure and/or seal the body portion 506 to the container portion 104.

With continued reference to FIGS. 5C and 6B, the support portion 508 can have a thickness T2 (e.g., measured perpendicular to the axis A1), a height H2 (e.g., measured parallel to the axis A1), and an outer diameter D2. The size and shape of the support portion 508 can correspond to (e.g., can be complementary to and/or sized to fit within) the size and shape of the recessed channel 520 of the body portion 506 such that the support portion 508 can be positioned within the recessed channel 520. The support portion 508 can be an annular support portion or member with a substantially annular shape (such as a ring shape). As shown in FIG. 5C, the thickness T2 of the support portion 508 can be slightly less than the thickness T4 of the recessed channel 520 such that the support portion 508 is slightly recessed from the outer surface of the wall 516 (e.g., recessed from the portion of the wall 516 with thickness T1). In other embodiments, the thickness T2 of the support portion 508 can be equal to the thickness T4 of the recessed channel 520 such that the support portion 508 sits flush with the outer surface of the wall 516 of the body portion 506. In yet other embodiments, the thickness T2 of the support portion 508 can be greater than the thickness T4 of the recessed channel 520 such that the support portion 508 extends radially outward beyond the outer surface of the wall 516 of the body portion 506.

In the embodiment illustrated in FIGS. 5C and 6B, the annotated dimensions of the body portion 506 and the support portion 508 can have the following approximate values: T1=3.95 mm, T2=0.8 mm, T3=3 mm, T4=0.85 mm, T5=3.1 mm, H1=30.2 mm, H2=18 mm, D1=60.4 mm, D2=60 mm, and D3=35 mm. It should be noted that these specific dimensions and tolerances are merely examples, and other dimensions and/or tolerances may be used. For example, one or more of T1, T1, T3, T4, T5, H1, H2, D1, D2, and D3 can have smaller or larger values in other embodiments. In other embodiments, any one or more of T1, T1, T3, T4, T5, H1, H2, D1, D2, and D3 can be increased or decreased in size by 1%, 5%, 10%, 25%, 50%, 75%, 100%, 150%, 200%, greater than 200%, or any intermediary value between two of the preceding percentages. In some embodiments, the values of thickness T1, thickness T3, and height H1 of the collar 504 can be the same as or similar to the values of thickness T1, thickness T3, and height H1 of the collar 1204 as described above.

The thickness T2 of the support portion 508 can be described as a ratio of the thickness T1 of the wall 516 of the body portion 506. For example, in the embodiment shown in FIG. 5C, the thickness T2 of the support portion 508 can be approximately 20% of the thickness T1 of the wall 516. In other embodiments, the thickness T2 of the support portion 508 can be approximately 1%, 5%, 10%, 15%, 25%, 30%, 50%, 75%, greater than 75%, or any intermediary value between two of the preceding percentages of the thickness T1 of the wall 516. In some embodiments, the thickness T2 can be no more than 1%, 5%, 10%, 15%, 25%, 30%, or 50% of the thickness T1. The height H2 of the support portion 508 can be described as a ratio of the height H1 of the body portion 506. For example, in the embodiment shown in FIG. 5C, the height H2 of the support portion 508 can be approximately 60% of the height H1 of the body portion 506. In other embodiments, the height H2 of the support portion 508 can be approximately 1%, 5%, 10%, 25%, 50%, 55%, 65%, 70%, 75%, greater than 75%, or any intermediary value between two of the preceding percentages of the height H1 of the body portion 506. In some embodiments, the height H2 of the support portion 508 can be no more than 1%, 5%, 10%, 25%, 50%, 55%, 65%, 70%, 75%, 80%, 90%, or 100% of the height H1 of the body portion 506. The thickness T3 of the ridge portion 512 can be described as a ratio of the thickness T1 of the wall 516. For example, in the embodiment shown in FIG. 5C, the thickness T3 of the ridge portion 512 can be approximately 76% of the thickness T1 of the wall 516. In other embodiments, the thickness T3 of the ridge portion 512 can be approximately 1%, 5%, 10%, 25%, 50%, 55%, 65%, 70%, 80%, 85%, 100%, 110%, 125%, greater than 125%, or any intermediary value between two of the preceding percentages of the thickness T1 of the wall 516. In some embodiments, the thickness T3 of the ridge portion 512 can be at least 50%, 55%, 65%, 70%, 80%, 85%, 100%, 110%, 125% of the thickness T1 of the wall 516 and/or of the thickness T5 of the wall 516.

FIG. 6C is an exploded view of the collar 504 of FIG. 5A. As shown in FIG. 6C, the body portion 506 and the support portion 508 of the collar 504 can be formed as separable components. The body portion 506 and the support portion 508 can be assembled together to form the collar 504. As shown in FIG. 6C, the recessed channel 520 can extend circumferentially around the body portion 506. The recessed channel 520 can be sized and shaped to receive the support portion 508. For example, the recessed channel 520 can be sized and shaped to receive the substantially annular shape of the support portion 508. In the embodiment shown in FIG. 6C, the support portion 508 forms a closed annulus (e.g., forms a closed loop). In other embodiments, the support portion 508 may include a gap such that the support portion 508 does not form a continuous closed loop. When the support portion 508 and the body portion 506 are assembled together, the support portion 508 can be positioned within the recessed channel 520.

In some embodiments, the recessed channel 520 can inhibit (e.g., prevent) movement of the support portion 508 relative to the body portion 506. In this manner, the recessed channel 520 can prevent the support portion 508 from slipping off of the body portion 506, for example, during installation of the collar 504 onto the container portion 104 or during use of the bottle 500. In some embodiments, the support portion 508 can be secured to the body portion 506 via mechanical engagement (e.g., frictional engagement) of the support portion 508 with the recessed channel 520. For example, the support portion 508 can be snap-fit into the recessed channel 520 or sized slightly larger than the recessed channel 520 such that it is compressively secured within the recessed channel 520. In other embodiments, the body portion 506 may not include a recessed channel 520. In some embodiments, the support portion 508 and the body portion 506 may not be separate components. For example, in some embodiments, the support portion 508 may be bonded to the body portion 506 (e.g., by an adhesive) or the support portion 508 may be embedded into the body portion 506 (see FIGS. 9A-9B).

In some embodiments, it may be advantageous to form the body portion 506 and the support portion 508 from different materials. For example, it may be advantageous to form the body portion 506 from silicone (or from another material that is relatively softer and/or more elastic than the support portion 508) and form the support portion 508 from stainless steel (or from another material that is harder and/or less elastic than the body portion 506). In this arrangement, the collar 504 can provide the benefits of a silicone construction discussed above (e.g., provide a better gripping surface, perform a sealing function between the mouthpiece portion 202 and the container portion 104, and/or provide a smoother threading connection) via the silicone body portion 506 while at least partially maintaining the benefits of a stainless steel construction discussed above (e.g., greater rigidity, less deformation of the collar 504 when tightening the collar 504 on the container portion 104) via the stainless steel support portion 508.

In some embodiments, one or more portions of the bottle 500 (e.g., the body portion 506, the support portion 508, the mouthpiece portion 202, and/or the container portion 104) can be made from medical grade silicone, 18/8 stainless steel, or other materials. In some embodiments, the body portion 506 and the support portion 508 can each be formed from different materials having different levels of hardness defined on the Shore A scale (or on the Rockwell B scale (HRB) or other scale(s)). Specifically, the body portion 506 can have a first hardness, and the support portion 508 can have a second hardness that is greater than the first hardness. In one example, the body portion 506 can comprise a silicone material with a hardness within a range of 65 to 80 on the Shore A scale, and the support portion 508 can comprise a stainless steel material with a hardness within a range of 70 to 85 HRB. For example, the body portion 506 and the support portion 508 can be formed from different silicone materials having different levels of hardness defined on the Shore A scale. For example, the body portion 506 can be made from a silicone material having a first hardness, and the support portion 508 can be made from a silicone material having a second hardness that is greater than the first hardness.

In some embodiments, the body portion 506 and the support portion 508 can each be formed from different materials having a different elasticity (e.g., different elastic modulus, such as measured in units of Gigapascal (GPa)). In some embodiments, the body portion 506 can comprise a material with a first elastic modulus, and the support portion 508 can comprise a material with a second elastic modulus that is greater than the first elastic modulus. In one example, the body portion 506 can comprise a silicone material with an elastic modulus within a range of 0.0005 to 0.062 GPa, and the support portion 508 can comprise a stainless steel material with an elastic modulus within a range of 190 to 210 GPa. In some embodiments, the support portion comprises a material with an elastic modulus that is at least 2, 5, 10, 100, 500, or 1000 times the elastic modulus of the body portion.

In other embodiments, it is to be understood that the body portion 506 and the support portion 508 can each be formed from other materials (e.g., stainless steel, plastics, polymers, rubbers, etc.) such that the support portion 508 has a greater hardness and/or elastic modulus than the body portion 506. In yet other embodiments, the body portion 506 and the support portion 508 can be formed from materials with the same hardness and/or elastic modulus. In yet other embodiments, the body portion 506 can be formed from a material with a greater hardness and/or elastic modulus than the material used to form the support portion 508.

Example Silicone Collar with Different Mouthpiece Portion

Figure 7A:
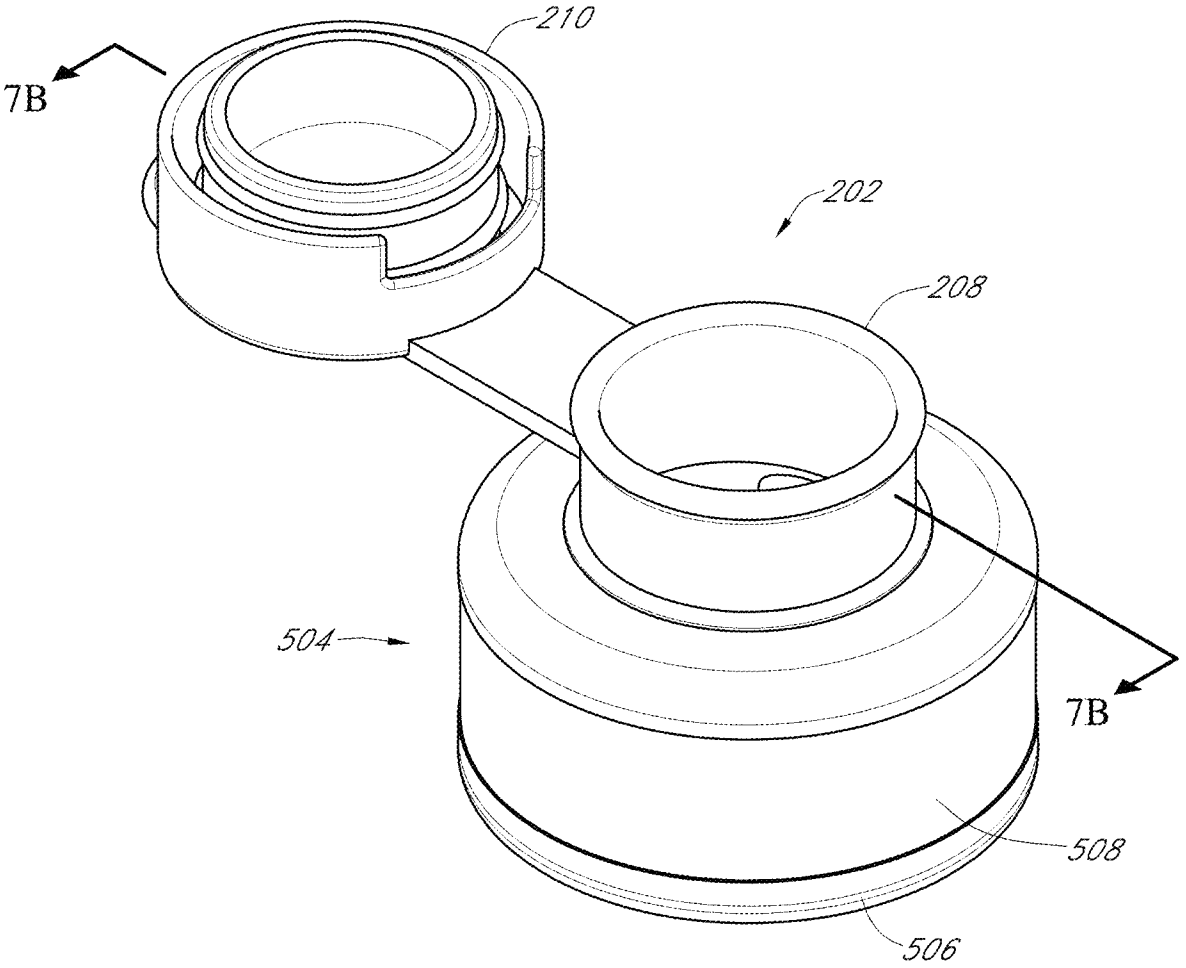
FIG. 7A is a perspective view of the collar of FIG. 5A, with an alternative mouthpiece portion installed.
Figure 7B:
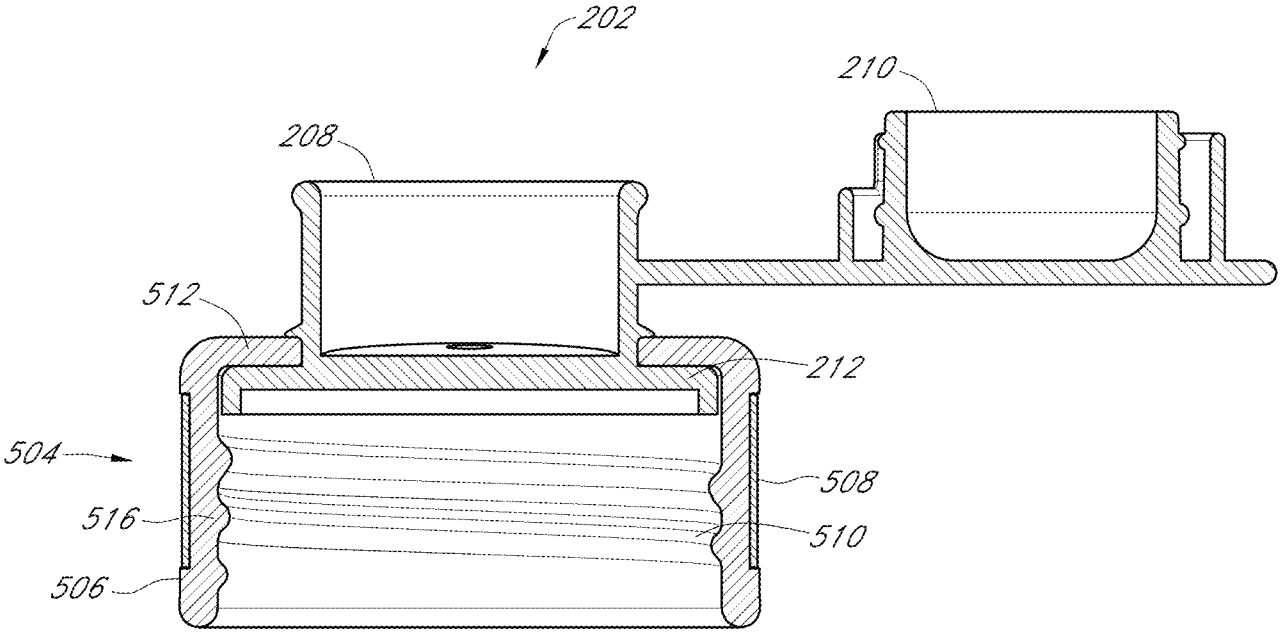
FIG. 7B is a cross-sectional view of the collar and the mouthpiece portion of FIG. 7A.

FIG. 7A is a perspective view of the collar 504 of FIG. 5A with an alternative mouthpiece portion 202 installed. FIG. 7B is a cross-sectional view of the collar 504 and the mouthpiece portion 202 of FIG. 7A. Specifically, FIGS. 7A-7B depict the collar 504 installed on a mouthpiece portion that is the same as or similar to the mouthpiece portion 202 disclosed by the '490 patent. As shown in FIGS. 7A-7B, the mouthpiece portion 202 can include a spout portion 208, a lower lip 212, and a lid 210. The spout portion 208 can form spout-like opening. The spout portion 208 can extend from the lower lip 212. The lid 210 can extend from the spout portion 208. The lid 210 can receive the spout portion 208 to cover and/or seal the spout portion 208. As shown in FIG. 7B, when the collar 504 is installed on the mouthpiece portion 202 the lower lip 212 of the mouthpiece portion 202 can be positioned adjacent (e.g., below) the ridge portion 512 of the body portion 506 of the collar 504. With continued reference to FIG. 7B, the spout portion 208 can extend through the top opening 518 of the body portion 506.

Example Silicone Collar with Integrated Silicone Spout

Figure 8A:
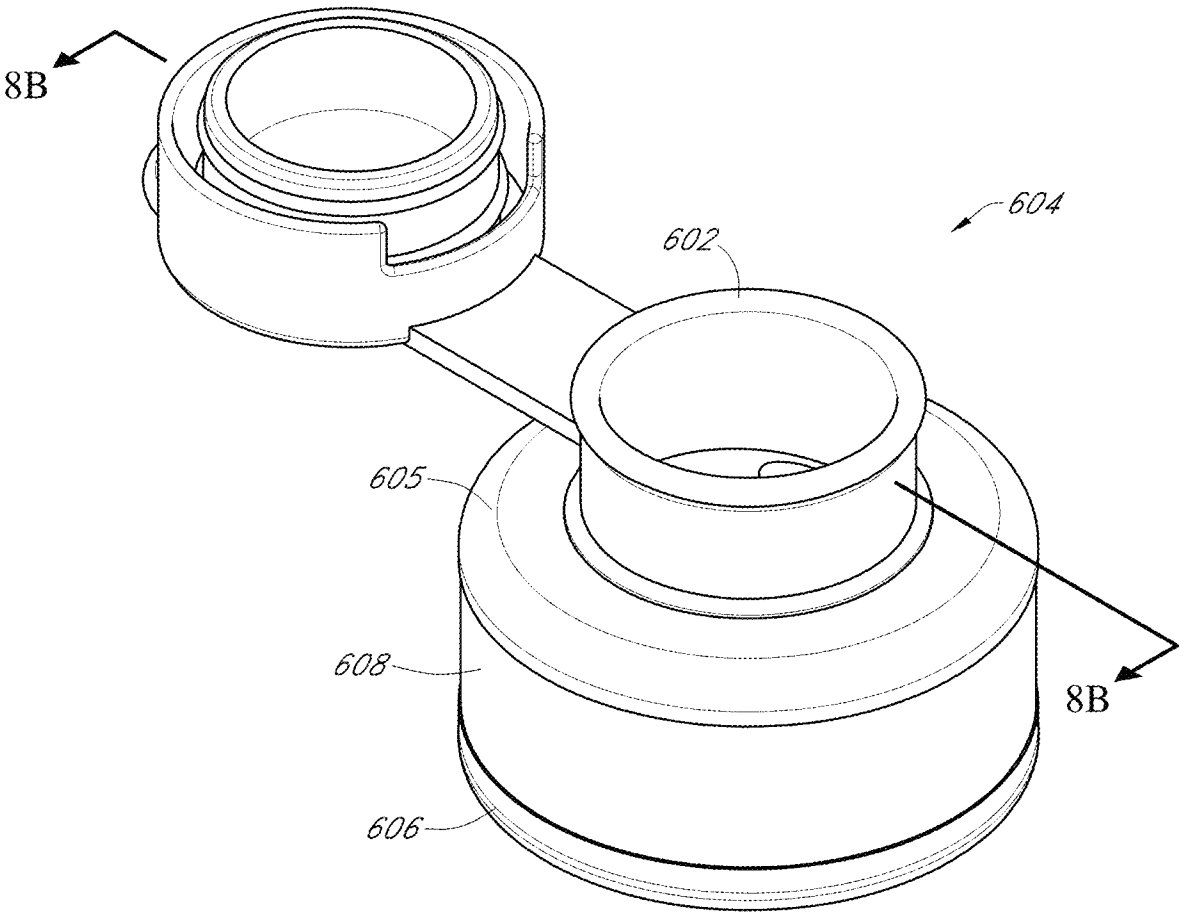
FIG. 8A is a perspective view of an example embodiment of a silicone collar with an integrated mouthpiece and body.
Figure 8B:
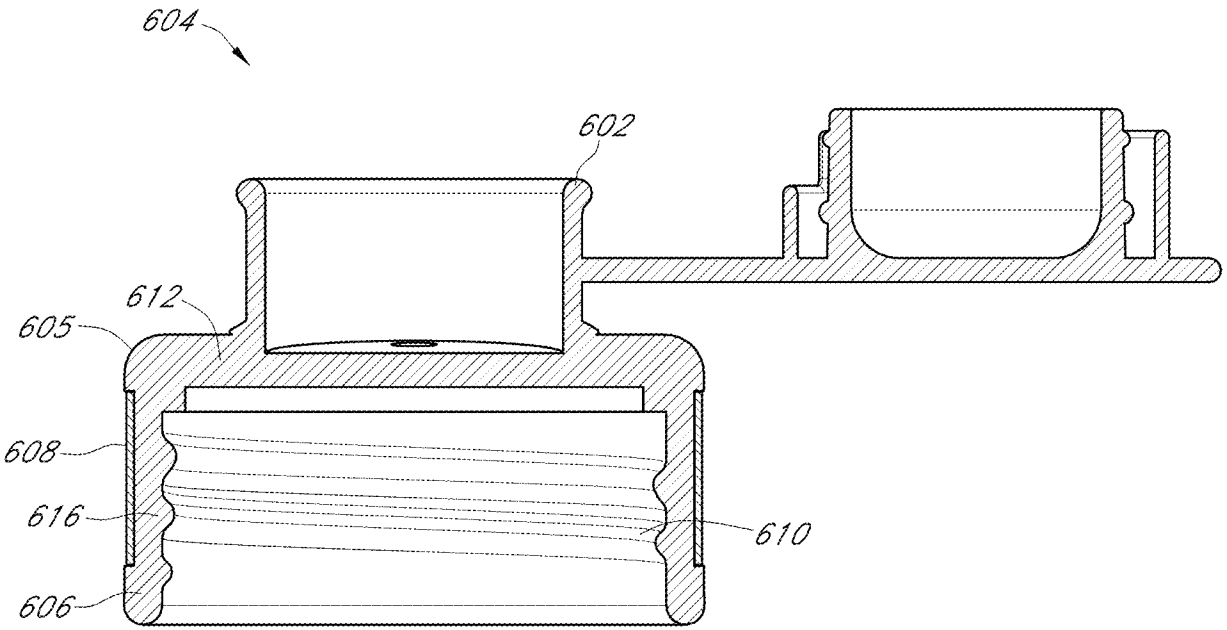
FIG. 8B is a cross-sectional view of the collar of FIG. 8A.

FIG. 8A is a perspective view of an example collar 604 with an integrated mouthpiece and body 605. FIG. 8B is a cross-sectional view of the collar 604 of FIG. 8A. As shown in FIGS. 8A-8B, the collar 604 can include an integrated mouthpiece and body 605 and a support portion 608. The integrated mouthpiece and body 605 can include a body portion 606 and a mouthpiece portion 602. The body portion 606 and the support portion 608 can each be the same as or similar to the body portion 506 and the support portion 508, respectively, of FIGS. 5A-7B. The mouthpiece portion 602 can be integrally formed with the body portion 606 such that the mouthpiece portion 602 and the body portion 606 form a unitary piece (not including support portion 608, which may be a separate piece). In the embodiment of FIGS. 8A-8B, the support portion 608 can remain a separable component from the integrated mouthpiece and body 605. As shown in FIG. 8B, the mouthpiece portion 602 can include the same or similar spout portion 208 and lid 210 of the mouthpiece portion 202 of FIGS. 7A-7B. With reference to FIGS. 8A-8B, the mouthpiece portion 602 may not include a corresponding lower lip 212. Rather, the corresponding spout portion can be integrally formed with and extend directly from the ridge portion 612 of the body portion 606. It is to be understood, that other types of mouthpiece portions (e.g., the mouthpieces portions 202 illustrated in FIGS. 1, 4, and 5A) can similarly be integrated into the body portion 606 of a collar 604 to form a unitary piece. In some embodiments, the integrated mouthpiece and body 605 can be made from a first material (e.g., silicone), and the support portion 608 can be made from a second material (e.g., stainless steel).

Example Silicone Collar with Embedded Support Portion

Figure 9B:
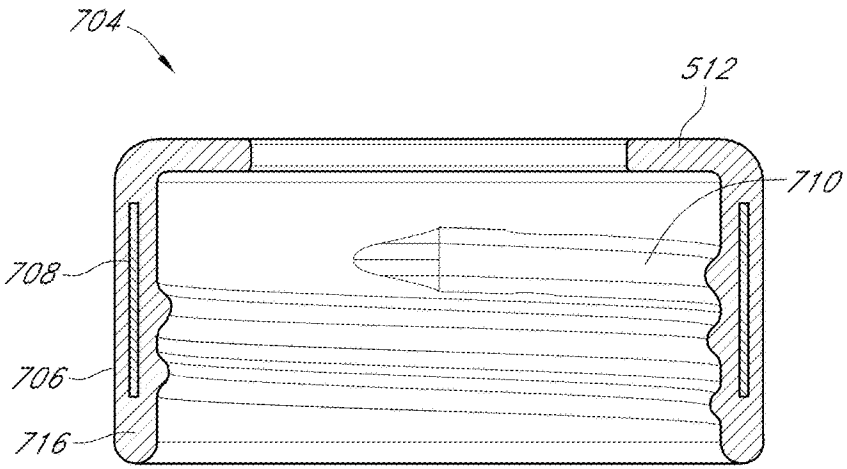
FIG. 9B is a cross-sectional view of the collar of FIG. 9A.
Figure 9A:
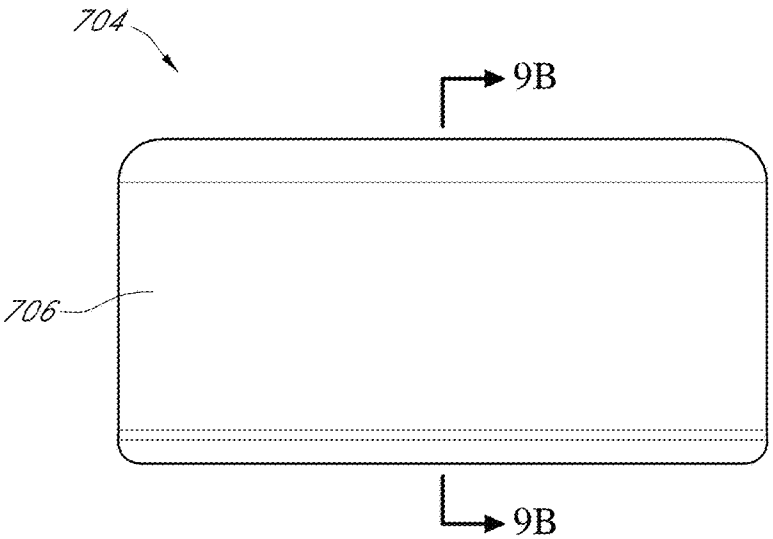
FIG. 9A is a side view of an example embodiment of a silicone collar with an embedded support portion.

FIG. 9A is a side view of an example collar 704 with an embedded support portion 708. FIG. 9B is a cross-sectional view of the collar 704 of FIG. 9A. With reference to FIGS. 9A-9B, the collar 704 can include a body portion 706 and a support portion 708. The body portion 706 can include one or more features of and can be used in the same or similar manner as the body portion 506 described above and shown in FIGS. 5A-7B. The support portion 708 can include one or more features of and can be used in the same or similar manner as the support portion 508 described above and shown in FIGS. 5A-7B. As shown in FIG. 9B, the support portion 708 can be embedded into the wall 716 of the body portion 706. In some embodiments, the support portion 708 can be embedded into the body portion 706 via an insert molding manufacturing process. In other embodiments, the body portion 706 can include a circumferential slit or opening to allow the support portion 708 to be interstitially inserted into the wall 716 of the body portion 706. As shown in FIGS. 9A-9B, the body portion 706 may not include a recessed channel 520 formed into the wall 716. Any of the disclosure herein with reference to other collars, such as describing particular dimensions, ratios, materials, material properties, and/or the like can apply to the embodiment shown in FIGS. 9A-9B. For example, collar 704 may be the same as collar 504, except for the positioning of the support portion 708 and the lack of recessed channel or groove 520.

Additional Example Silicone Collars with Support Portions

FIGS. 10A-11B depict example collars 804, 904 with anti-rotation, anti-movement, and/or securement features 830, 930. The one or more anti-rotation features 830, 930 can inhibit (e.g., prevent or restrict) axial and/or rotational movement of the support portion 808, 908 relative to the body portion 806, 906. Accordingly, the anti-rotation features 830, 930 can provide additional securement of the support portion 808, 908 to the body portion 806, 906. In some embodiments, the collar 804, 904 can include zero, one, two, three, four, or any other number of anti-rotation features 830, 930. Any of the disclosure herein with reference to other collars, such as describing particular dimensions, ratios, materials, material properties, and/or the like can apply to the embodiments shown in FIGS. 10A-11B. For example, collars 804, 904 may be the same as collar 504, except for the addition of features 830, 930.

Figure 10B:
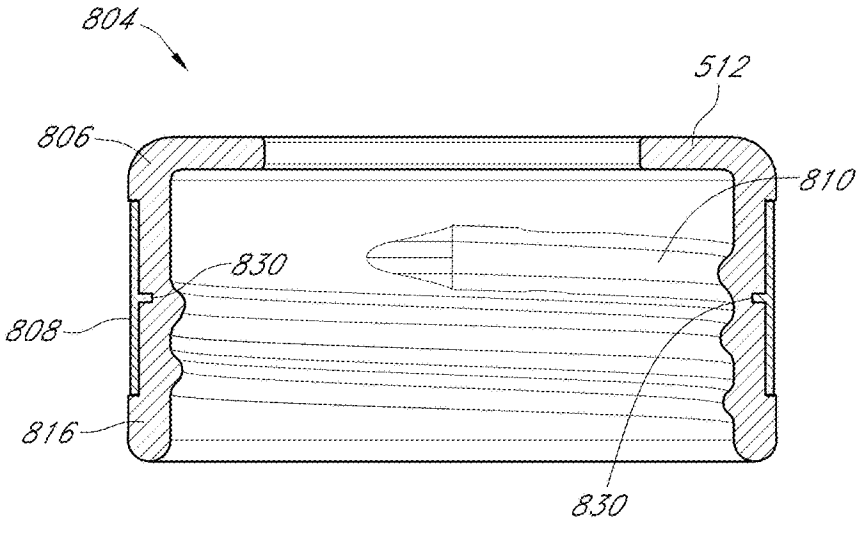
FIG. 10B is a cross-sectional view of the collar of FIG. 10A.
Figure 10A:
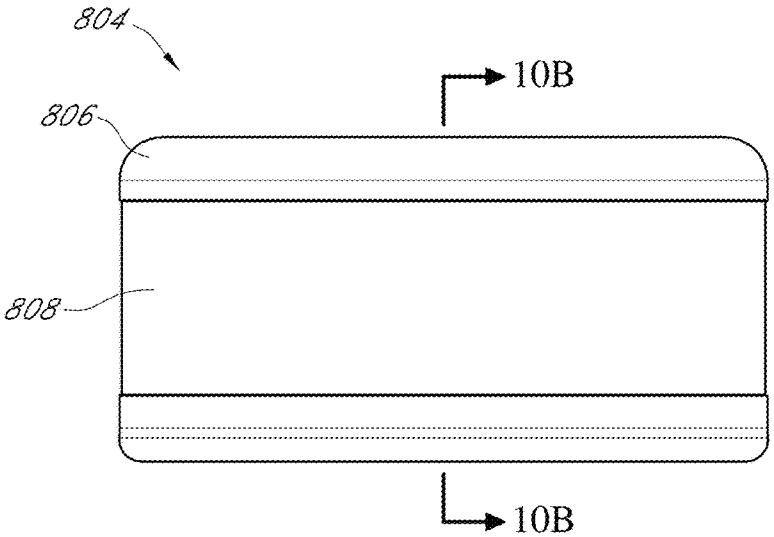
FIG. 10A is a side view of an example embodiment of a silicone collar with a support portion having anti-rotation features.

FIG. 10A is a side view of an example collar 804 with a support portion 808 having anti-rotation features 830. FIG. 10B is a cross-sectional view of the collar 804 of FIG. 10A. The collar 804 can be similar or identical to the collar 504 of FIGS. 5A-7B except for the addition of one or more anti-rotation features 830. As shown in FIG. 10B, each anti-rotation feature 830 can include a protrusion, finger, shaft, or the like extending from an interior surface of the support portion 808 and a corresponding slot, opening, depression, or the like formed into the wall 816 of the body portion 806. The slot can be sized and shaped to receive the protrusion extending from the support portion 808. As shown in FIG. 10B, when the support portion 808 is installed onto the body portion 806, the protrusion can be secured within the slot. The protrusion and the slot can each have a circular, rectangular, triangular, or any other shaped cross-section.

Figure 11B:
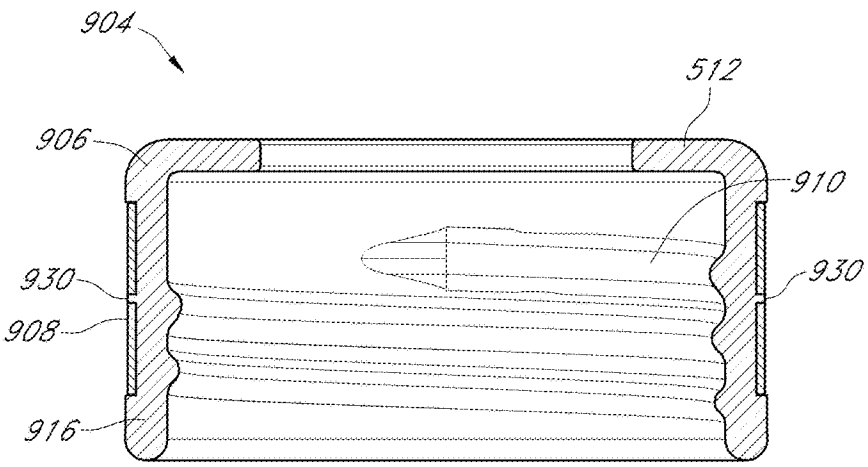
FIG. 11B is a cross-sectional view of the collar of FIG. 11A.
Figure 11A:
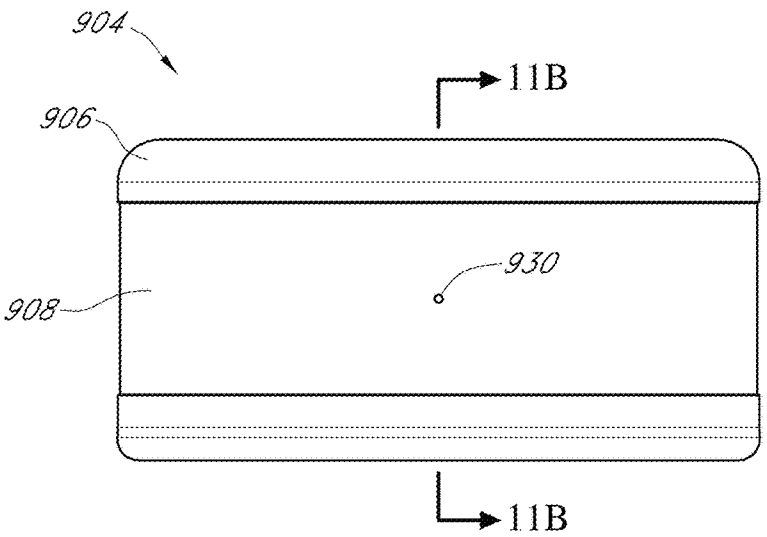
FIG. 11A is a side view of another example embodiment of a silicone collar with a body portion having anti-rotation features.

FIG. 11A is a side view of an example collar 904 with a body portion 906 having anti-rotation features 930. FIG. 11B is a cross-sectional view of the collar 904 of FIG. 11A. The collar 904 can be similar or identical to the collar 504 of FIGS. 5A-7B except for the addition of one or more anti-rotation features 930. As shown in FIG. 10B, each anti-rotation feature 930 can include a protrusion extending from an exterior surface of the wall 916 of the body portion 906 and a corresponding slot (e.g., a through-hole or recess) formed into an interior surface of the support portion 908. The slot can be sized and shaped to receive the protrusion extending from the body portion 906. As shown in FIG. 10B, when the support portion 908 is installed onto the body portion 906, the protrusion can be secured within the slot. The protrusion and the slot can each have a circular, rectangular, triangular, or any other shaped cross-section.

While FIGS. 10A-11B depicts the one or more anti-rotation features 830, 930 as including a protrusion and a corresponding slot, it is to be understood that the one or more anti-rotation features 830, 930 can include any other mechanism for inhibiting relative movement between the support portion 808, 908 and the body portion 806, 906. For example, in other embodiments, the one or more anti-rotation features 830, 930 can include a locking mechanism, a clip, a buckle, adhesive, or other similar mechanisms known in the art.

In some embodiments, the bottle 100 of FIG. 1A can also include a support portion (e.g., a support portion that is similar or identical to any of the support portions 508, 608, 708, 808, 908 disclosed herein). For example, the support portion can be coupled to the collar 204, collar 1204, or collar 4004 in the same manner that any of the support portions 508, 608, 708, 808, 908 can be coupled to the respective body portions 506, 606, 706, 806, 906. Specifically, in some embodiments, the support portion can be positioned around an exterior surface of any of the collars 204, 1204, 4004. In some embodiments, the inner radius of the support portion can be equal to or slightly smaller than the outer radius of any of the collars 204, 1204, 4004 such that the support portion is tightly fit and compressively secured around the collars 204, 1204, 4004. The support portion can be advantageously coupled to any of the collars 204, 1204, 4004 to provide additional securement of the collars 204, 1204, 4004 to the container portion 104 and/or to provide additional rigidity to the collars 204, 1204, 4004. In some embodiments, any of the body portions 506, 606, 706, 806, 906 described herein can be identical to or structurally similar to any of the collars 204, 1204, 4004 described herein (e.g., any of the collars 204, 1204, 4004 can be body portions when coupled with a support portion). In some embodiments, any of the collars 204, 1204, 4004 can include a recessed channel similar or identical to the recessed channel 520 of the body portion 506 such that the support portion can be secured to the collar 204, 1204, 4004 via the recessed channel.

Although certain preferred embodiments and examples have been disclosed above, it will be understood by those skilled in the art that the present disclosure extends beyond the specifically disclosed embodiments to other alternative embodiments and/or uses and obvious modifications and equivalents thereof. Additionally, it is contemplated that various aspects and features described can be practiced separately, combined together, or substituted for one another, and that a variety of combination and sub-combinations of the features and aspects can be made and still fall within the scope of the disclosure. Thus, it is intended that the scope of the present disclosure should not be limited by the particular disclosed embodiments described above, but should be determined only by a fair reading of the claims.

What is claimed is:

1. A bottle comprising:

a container portion comprising a neck portion that comprises a first thread adjacent a lip, the lip defining an opening that enables access to an internal cavity of the container portion, wherein at least the first thread of the neck portion of the container portion comprises stainless steel;

a silicone mouthpiece portion comprising a mouth interface portion and a lower sealing surface sized to mate with the lip of the neck portion of the container portion; and a collar comprising a silicone main body and a stainless steel annular support ring, wherein the silicone main body of the collar comprises:

an annular wall;

an annular ridge extending radially inward from an upper portion of the annular wall; and a second thread extending radially inward from the annular wall, the second thread configured to threadingly engage the first thread of the neck portion of the container portion in order to cause the annular ridge to force the lower sealing surface of the silicone mouthpiece portion against the lip of the neck portion of the container portion, to seal the silicone mouthpiece portion to the container portion, wherein the stainless steel annular support ring has a fixed diameter, and wherein the stainless steel annular support ring is positioned around and radially outward of the second thread in order to resist expansion of the annular wall in response to the second thread being tightened against the first thread.

2. The bottle of claim 1, wherein the annular wall comprises an annular recess around an outer surface thereof, and wherein the stainless steel annular support ring is positioned at least partially within the annular recess.

3. The bottle of claim 1, wherein the stainless steel annular support ring is positioned within the annular wall.

4. The bottle of claim 1, wherein the silicone main body of the collar comprises a silicone material that is harder than a silicone material of the silicone mouthpiece portion.

5. The bottle of claim 1, wherein the annular ridge of the silicone main body of the collar comprises a first thickness, measured along a direction parallel to a central axis of the second thread, the stainless steel annular support ring comprises a second thickness, measured along a direction perpendicular to the central axis of the second thread, and the first thickness is at least two times the second thickness.

6. The bottle of claim 5, wherein the annular wall comprises a third thickness, measured along the direction perpendicular to the central axis of the second thread, and the third thickness is at least two times the second thickness.

7. The bottle of claim 6, wherein the stainless steel annular support ring comprises an inner surface that is positioned radially inward from an outer surface of the annular wall, and wherein the third thickness is a minimum thickness of the annular wall between the inner surface of the stainless steel annular support ring and the second thread.

8. A collar for a bottle having a container portion and a mouthpiece portion, the collar comprising:

a body portion comprising a silicone material that forms:

an annular wall having a top portion and an opposing bottom portion, wherein the bottom portion of the annular wall defines a bottom opening configured to receive the container portion;

at least one thread extending inwardly from the annular wall; and a ridge portion extending inwardly from the top portion of the annular wall, wherein the ridge portion defines a top opening through which the mouthpiece portion can be inserted, wherein the body portion is configured to removably couple the mouthpiece portion to the container portion; and an annular support portion coupled to and extending circumferentially around the annular wall of the body portion, wherein the annular support portion has a fixed diameter, and wherein the annular support portion is configured to resist radial expansion of the annular wall in response to the body portion being secured to the mouthpiece portion and to the container portion.

9. The collar of claim 8, wherein the body portion further comprises at least one thread extending inwardly from the annular wall, wherein the at least one thread is configured to engage a corresponding thread of the container portion to seal the mouthpiece portion to the container portion.

10. The collar of claim 8, wherein the annular support portion comprises a stainless steel material.

11. The collar of claim 8, wherein the body portion comprises a material having a first hardness, and the annular support portion comprises a material having a second hardness, wherein the second hardness is greater than the first hardness.

12. The collar of claim 8, wherein the body portion further comprises a recessed channel formed into an exterior surface of the annular wall, wherein the recessed channel is configured to receive the annular support portion.

13. The collar of claim 8, wherein a thickness of the annular support portion, measured along a direction perpendicular to a central axis of the annular wall, is no more than 30% of a maximum thickness of the annular wall, measured along a direction perpendicular to the central axis of the annular wall.

14. The collar of claim 8, wherein a thickness of the ridge portion, measured along a direction parallel to a central axis of the annular wall, is at least 60% of a maximum thickness of the annular wall, measured along a direction perpendicular to the central axis of the annular wall.

15. A bottle comprising:

a container portion comprising a neck portion that comprises a first thread adjacent a first lip, the first lip defining an opening that enables access to an internal cavity of the container portion;

a mouthpiece portion comprising a mouth interface portion and a second lip; and a collar comprising a main body and an annular support member, wherein the main body of the collar comprises a silicone material that forms:

an annular wall;

a third lip extending radially inward from an upper portion of the annular wall; and a second thread extending radially inward from the annular wall, the second thread configured to threadingly engage the first thread of the neck portion of the container portion in order to cause the third lip to force the second lip of the mouthpiece portion against the first lip of the neck portion of the container portion, to seal the mouthpiece portion to the container portion, wherein the annular support member is positioned around and radially outward of the second thread in order to resist expansion of the annular wall in response to the second thread being tightened against the first thread during coupling of the collar to the container portion, and wherein the annular support member comprises a material having an elastic modulus that is at least five times an elastic modulus of the silicone material of the main body of the collar.

16. The bottle of claim 15, wherein the annular support member comprises stainless steel.

17. The bottle of claim 15, wherein the annular support member comprises a material having an elastic modulus that is at least 100 times the elastic modulus of the silicone material of the main body of the collar.

18. The bottle of claim 15, wherein the annular wall comprises an annular recess around an outer surface thereof, and wherein the annular support member is positioned at least partially within the annular recess.

19. The bottle of claim 15, wherein the silicone material of the main body of the collar comprises a higher hardness than a silicone material of the mouthpiece portion.

20. The bottle of claim 15, wherein the third lip of the main body of the collar comprises a first thickness, measured along a direction parallel to an axis of the second thread, the annular support member comprises a second thickness, measured along a direction perpendicular to the axis of the second thread, and the first thickness is at least two times the second thickness.

* * * * *